US009530269B2

(12) United States Patent
Momose

(10) Patent No.: US 9,530,269 B2
(45) Date of Patent: Dec. 27, 2016

(54) DEVICE FOR IDENTIFYING COIN-SHAPED IDENTIFICATION OBJECT

(71) Applicant: NIDEC SANKYO CORPORATION, Suwa-gun, Nagano (JP)

(72) Inventor: Shogo Momose, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 0 days.

(21) Appl. No.: 15/024,695

(22) PCT Filed: Sep. 5, 2014

(86) PCT No.: PCT/JP2014/073549
§ 371 (c)(1),
(2) Date: Mar. 24, 2016

(87) PCT Pub. No.: WO2015/045812
PCT Pub. Date: Apr. 2, 2015

(65) Prior Publication Data

US 2016/0240029 A1 Aug. 18, 2016

(30) Foreign Application Priority Data

Sep. 24, 2013 (JP) ..... 2013-196401

(51) Int. Cl.
*G07D 5/08* (2006.01)

(52) U.S. Cl.
CPC ..... *G07D 5/08* (2013.01)

(58) Field of Classification Search
CPC .... G07D 5/08; G07D 11/0003; G07D 11/0036
USPC ..... 194/317, 318, 320
See application file for complete search history.

(56) References Cited

U.S. PATENT DOCUMENTS 6,098,777 A * 8/2000 Hoffman ..... G07D 5/08 194/318

FOREIGN PATENT DOCUMENTS

| | | | |
|---|---|---|---|
| EP | 2626839 | A1 | 8/2013 |
| JP | 2003051042 | A | 2/2003 |
| JP | 2010162143 | A | 7/2010 |
| JP | 2013164708 | A | 8/2013 |

OTHER PUBLICATIONS

International Search Report corresponding to Application No. PCT/JP2014/073549; Date of Mailing: Oct. 7, 2014, with English translation, (2 pages).

* cited by examiner

*Primary Examiner* — Mark Beauchaine
(74) *Attorney, Agent, or Firm* — Cantor Colburn LLP

(57) ABSTRACT

A device for identifying an object to identify may include a passage through which the object passes; an exciting coil and a detection coil; a core body around which the exciting coil and the detection coil are wound; and a control unit to which the detection coil is connected. The core body may include a first core and a second core. An analog coil output signal may be input into the control unit, a signal level of the coil output signal rising if the identification object passes through the passage path. The control unit may obtain a signal value of the coil output signal and identify the object.

8 Claims, 13 Drawing Sheets

DEVICE FOR IDENTIFYING COIN-SHAPED IDENTIFICATION OBJECT

CROSS REFERENCE TO RELATED APPLICATIONS

This is the U.S. national stage of application No. PCT/JP2014/073549, filed on Sep. 5, 2014. Priority under 35 U.S.C. §119(a) and 35 U.S.C. §365(b) is claimed from Japanese Application No. 2013-196401, filed Sep. 24, 2013; the disclosure of which is incorporated herein by reference.

FIELD OF THE INVENTION

The present invention relates to a device for identifying a coin-shaped identification object to identify authenticity and good/bad condition of a coin-shaped identification object.

BACKGROUND

Conventionally, known is a medal detection device to be used for a slot machine (for example, refer to Patent Document 1). A medal detection device described in Patent Document 1 is provided with two types of sensors in a medal flow path; i.e., one is an optical sensor that changes its amount of light received at a time when a medal, thrown in from a medal inlet port, passes through, and the other is a capacitance sensor that changes its capacitance at a time when a medal passes through. A medal is identified in the medal detection device, by use of those two types of sensors.

PRIOR ART DOCUMENT

Patent Document

Patent Document 1; Japanese Unexamined Patent Application Publication No. 2010-162143

Slot machines, in which lots of medals are continuously thrown in from a medal inlet port, start gaining in popularity in recent years. Moreover, even in the case where quite a few medals are not necessarily thrown in continuously from the medal inlet port, sometimes lots of medals are accumulated before a medal detection device, owing to an effect of a friction resistance and the like in a medal transfer path from the medal inlet port to the medal detection device, so that the lots of medals continuously pass through the medal detection device. Accordingly, the market requires a medal detection device that can identify medals, passing through continuously, at high speed.

SUMMARY

Then, at least an embodiment of the present invention provides a device for identifying a coin-shaped identification object that can identify a coin-shaped identification object at high speed.

In order to bring a solution for the subject described above; a device for identifying a coin-shaped identification object according to at least an embodiment of the present invention is a device for identifying a coin-shaped identification object to identify authenticity and/or good/bad condition of a coin-shaped identification object of multiple types, and the device includes: a passage path formed internally, through which the identification object passes through; an exciting coil and a detection coil; a core body around which the exciting coil and the detection coil are wound; and a control unit to which the detection coil is connected; wherein, the core body includes a first core, placed at one side in a thickness direction of the identification object passing through the passage path, the exciting coil being wound around the first core; and a second core, placed at the other side in the thickness direction of the identification object passing through the passage path, the detection coil being wound around the second core; an analog coil output signal created on the basis of an output from the detection coil is input into the control unit, a signal level of the coil output signal rising if the identification object passes through the passage path; the control unit obtains a signal value of the coil output signal at a time when the signal level of the coil output signal is equal to or higher than a predetermined threshold, and identifies the identification object, on the basis of the obtained signal value of the coil output signal; and among identification objects of multiple types, to be identified as authentic identification objects and/or those in good condition; an identification object having a largest outer diameter, a thickest thickness, and a lowest electrical resistivity is dealt with as a first identification object; and meanwhile, among identification objects of multiple types, to be identified as authentic identification objects and/or those in good condition; an identification object having a smallest outer diameter, a thinnest thickness, and a highest electrical resistivity is dealt with as a second identification object; and where a first thickness represents the thickness of the core body in a passing direction of the identification objects in the case where a bottom value of the signal level of the coil output signal, at a time when a plurality of first identification objects continuously pass with no space between every two of the first identification objects through the passage path, is equal to a peak value of the signal level of the coil output signal, at a time when the second identification objects pass through the passage path; a thickness of the core body in the passing direction of the identification objects is less than the first thickness.

Meanwhile, in order to bring a solution for the subject described above; a device for identifying a coin-shaped identification object according to at least an embodiment of the present invention is a device for identifying a coin-shaped identification object to identify authenticity and/or good/bad condition of a coin-shaped identification object of multiple types, and the device includes: a passage path formed internally, through which the identification object passes through; an exciting coil and a detection coil; a core body around which the exciting coil and the detection coil are wound; and a control unit to which the detection coil is connected; wherein, the core body includes a first core, placed at one side in a thickness direction of the identification object passing through the passage path, the exciting coil being wound around the first core; and a second core, placed at the other side in the thickness direction of the identification object passing through the passage path, the detection coil being wound around the second core; an analog coil output signal created on the basis of an output from the detection coil is input into the control unit, a signal level of the coil output signal falling if the identification object passes through the passage path; the control unit obtains a signal value of the coil output signal at a time when the signal level of the coil output signal is equal to or lower than a predetermined threshold, and identifies the identification object, on the basis of the obtained signal value of the coil output signal; and among identification objects of multiple types, to be identified as authentic identification objects and/or those in good condition; an identification object having a largest outer diameter, a thickest thickness, and a lowest electrical resistivity is dealt with as a first identification object; and meanwhile, among identification objects of multiple types, to be identified as authentic identification objects and/or those in good condition; an identification object having a smallest outer diameter, a thinnest thickness, and a highest electrical resistivity is dealt with as a second identification object; and where a first thickness represents the thickness of the core body in a passing direction of the identification objects in the case where a peak value of the signal level of the coil output signal, at a time when a plurality of first identification objects continuously pass with no space between every two of the first identification objects through the passage path, is equal to a bottom value of the signal level of the coil output signal, at a time when the second identification objects pass through the passage path; a thickness of the core body in the passing direction of the identification objects is less than the first thickness.

In the device for identifying a coin-shaped identification object according to at least an embodiment of the present invention, the control unit obtains the signal value of the coil output signal at the time when the signal level of the coil output signal is equal to or higher than a predetermined threshold, or the signal level of the coil output signal is equal to or lower than a predetermined threshold, and then identifies the identification object, on the basis of the obtained signal value of the coil output signal. Therefore, in comparison with a case where a signal value of the coil output signal is obtained at a constant sampling period, regardless of the signal level of the coil output signal; the amount of data of the signal value, which the control unit obtains and handles, can be reduced according to at least an embodiment of the present invention, so that the handling process of the control unit can be simplified. Therefore, according to at least an embodiment of the present invention, it becomes possible to speed up the handling process of the control unit; and as a result, the coin-shaped identification object can be identified at high speed.

Moreover, according to at least an embodiment of the present invention; among identification objects of multiple types, to be identified as authentic identification objects and/or those in good condition; an identification object having a largest outer diameter, a thickest thickness, and a lowest electrical resistivity is dealt with as a first identification object; and meanwhile, among identification objects of multiple types, to be identified as authentic identification objects and/or those in good condition; an identification object having a smallest outer diameter, a thinnest thickness, and a highest electrical resistivity is dealt with as a second identification object; and where a first thickness represents the thickness of the core body in a passing direction of the identification objects in the case where a bottom value of the signal level of the coil output signal, at a time when a plurality of first identification objects continuously pass with no space between every two of the first identification objects through the passage path, is equal to a peak value of the signal level of the coil output signal, at a time when the second identification objects pass through the passage path; a thickness of the core body in the passing direction of the identification objects is less than the first thickness. Therefore, according to at least an embodiment of the present invention, the threshold can be specified in such a way that the bottom value of the signal level of the coil output signal becomes lower than the threshold, at a time when each of the plurality of identification objects passes through the passage path, even in the case where any multiple identification objects among the identification objects of multiple types, to be identified as authentic identification objects and/or those in good condition, continuously pass with no space between every two of the identification objects through the passage path; and moreover, the peak value of the signal level of the coil output signal becomes higher than the threshold, even in the case where any of the identification objects of multiple types, to be identified as authentic identification objects and/or those in good condition, pass through the passage path.

Otherwise, according to at least an embodiment of the present invention; among identification objects of multiple types, to be identified as authentic identification objects and/or those in good condition; an identification object having a largest outer diameter, a thickest thickness, and a lowest electrical resistivity is dealt with as a first identification object; and meanwhile, among identification objects of multiple types, to be identified as authentic identification objects and/or those in good condition; an identification object having a smallest outer diameter, a thinnest thickness, and a highest electrical resistivity is dealt with as a second identification object; and where a first thickness represents the thickness of the core body in a passing direction of the identification objects in the case where a peak value of the signal level of the coil output signal, at a time when a plurality of first identification objects continuously pass with no space between every two of the first identification objects through the passage path, is equal to a bottom value of the signal level of the coil output signal, at a time when the second identification objects pass through the passage path; a thickness of the core body in the passing direction of the identification objects is less than the first thickness. Therefore, according to at least an embodiment of the present invention, the threshold can be specified in such a way that the top value of the signal level of the coil output signal becomes higher than the threshold, at a time when each of the plurality of identification objects passes through the passage path, even in the case where any multiple identification objects among the identification objects of multiple types, to be identified as authentic identification objects and/or those in good condition, continuously pass with no space between every two of the identification objects through the passage path; and moreover, the bottom value of the signal level of the coil output signal becomes lower than the threshold, even in the case where any of the identification objects of multiple types, to be identified as authentic identification objects and/or those in good condition, pass through the passage path.

Therefore, according to at least an embodiment of the present invention; even though authenticity and good/bad condition of multiple types of the identification object can be identified, and moreover even in the case where a plurality of identification objects continuously pass with no space between every two of the identification objects through the passage path; the amount of data of the signal values, which the control unit obtains and handles, can be reduced so that the handling process of the control unit can be simplified. Then, according to at least an embodiment of the present invention; even though authenticity and good/bad condition of multiple types of the identification object can be identified, and moreover even in the case where a plurality of identification objects continuously pass with no space between every two of the identification objects through the passage path; it becomes possible to speed up the handling process of the control unit; and as a result, the identification objects can be identified at high speed.

Furthermore, according to at least an embodiment of the present invention; the threshold can be specified in such a way that the bottom value of the signal level of the coil output signal becomes lower than the threshold, at a time when each of the plurality of identification objects passes through the passage path, or the threshold can be specified in such a way that the top value of the signal level of the coil output signal becomes higher than the threshold, at a time when each of the plurality of identification objects passes through the passage path. Accordingly, it becomes possible to obtain the signal value of the coil output signal of each of the identification objects, at a predetermined time interval, even in the case where the plurality of identification objects continuously pass with no space between every two of the identification objects through the passage path. Therefore, according to at least an embodiment of the present invention, it becomes possible to appropriately identify authenticity and good/bad condition of each of the plurality of identification objects on the basis of the obtained signal value of the coil output signal, even in the case where the plurality of identification objects continuously pass with no space between every two of the identification objects through the passage path. Furthermore, according to at least an embodiment of the present invention, it becomes possible to easily calculate the number of the identification objects passing through the passage path.

In at least an embodiment of the present invention; for example, an outer diameter of the identification object is equal to or greater than 20 mm, and equal to or smaller than 32 mm; a thickness of the identification object is equal to or thicker than 1.3 mm, and equal to or thinner than 2.5 mm; and a material of the identification object is one of aluminum alloy, stainless steel, brass, bronze, and cupronickel. Alternatively, in at least an embodiment of the present invention; for example, the outer diameter of the identification object is equal to or greater than 20 mm, and equal to or smaller than 30 mm; the material of the identification object is one of stainless steel, brass, bronze, and cupronickel; and the first thickness is 1.2 mm.

In at least an embodiment of the present invention; it is preferable that the core body is configured as one metal plate that is made up by way of press working; and the core body is placed in such a way that the passing direction of the identification objects is a thickness direction of the core body. By configuring this way, a structure of the core body can be simplified.

As described above, in the device for identifying a coin-shaped identification object according to at least an embodiment of the present invention, it becomes possible to identify a coin-shaped identification object at high speed.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIGS. 7A-7E are diagrams showing a state at a time when a medal passes through the circular core shown in FIG. 2.

REFERENCE NUMERALS

Figure 1:
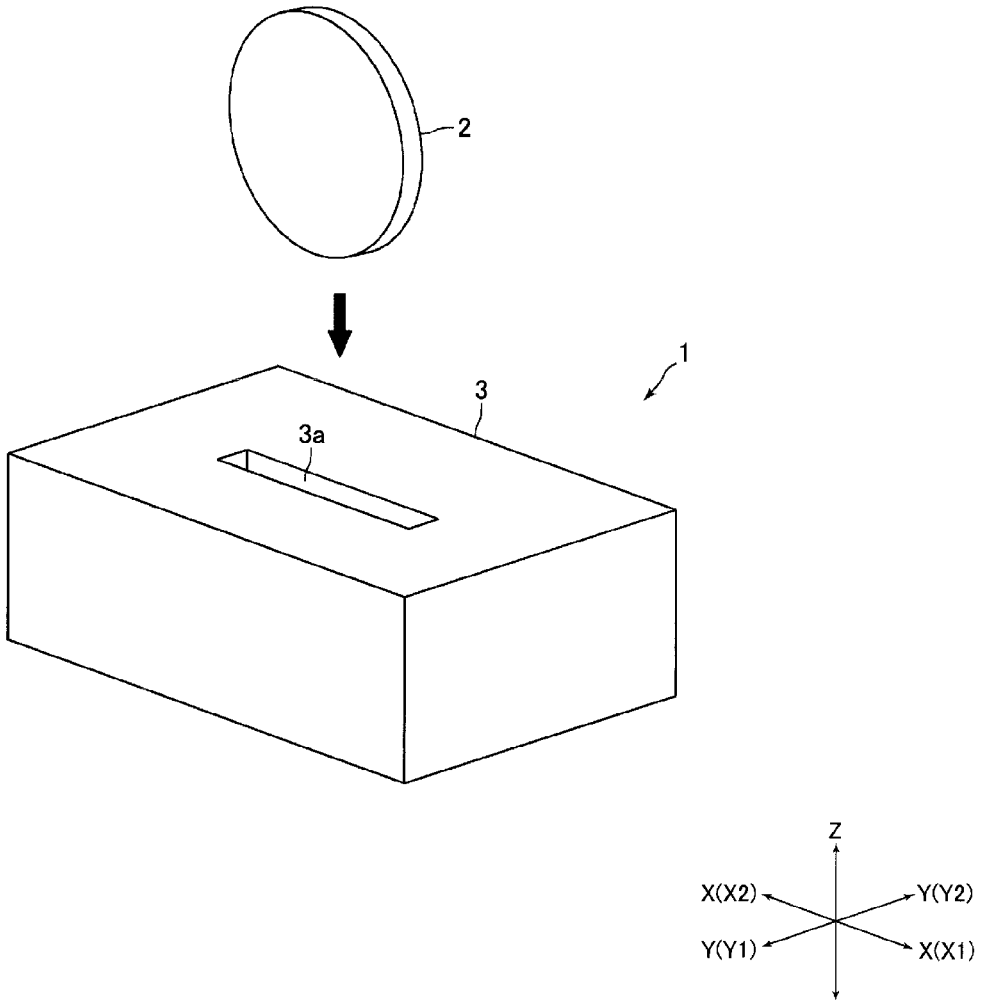
FIG. 1 is a perspective view of a device for identifying a coin-shaped identification object according to an embodiment of the present invention.

1. medal identification device (device for identifying a coin-shaped identification object)
2. medal (identification object)
5. passage path
8. exciting coil
9. detection coil
11. circular core (core body)
12. first core
13. second core
29. MPU (control unit)
B11. bottom value
'h'. thickness of core body
P12. peak value
SG1, and SG11 through SG16. coil output signals
'th'. threshold
'Y'. thickness direction of an identification object
'Z'. passing direction of an identification object

DETAILED DESCRIPTION

An embodiment of the present invention is explained below with reference to the accompanying drawings.

(General Structure of the Device for Identifying a Coin-Shaped Identification Object)

Figure 2:
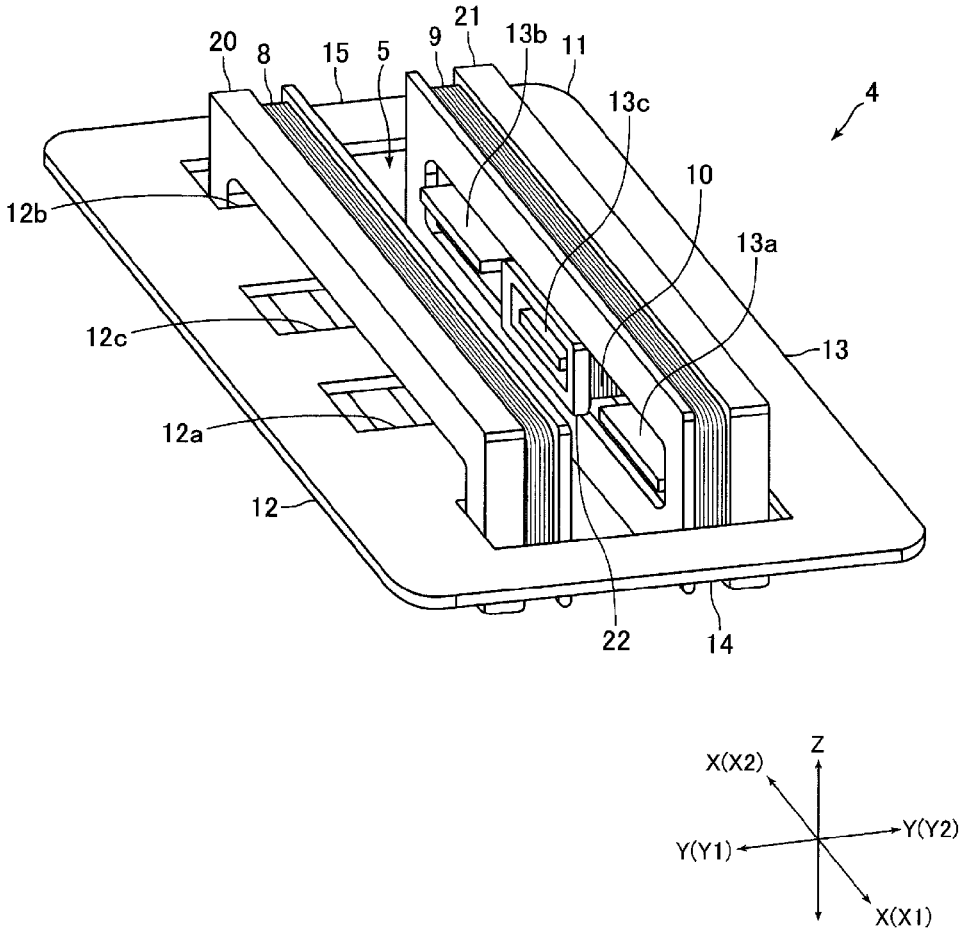
FIG. 2 is a perspective view showing a state where a case body has been removed from the device for identifying a coin-shaped identification object under conditions shown in FIG. 1.

FIG. 1 is a perspective view of a device for identifying a coin-shaped identification object 1, according to an embodiment of the present invention. FIG. 2 is a perspective view showing a state where a case body 3 has been removed from the device for identifying a coin-shaped identification object 1 under conditions shown in FIG. 1.

The device for identifying a coin-shaped identification object 1, according to the present embodiment, is a device to identify authenticity of a medal 2 that is a coin-shaped identification object, and to identify good/bad condition of the medal 2 being authentic (whether the medal is in good condition or bad condition; namely, whether or not the medal 2 being authentic has abrasion, deformation, and the like so as to be a defective medal); and the device for identifying a coin-shaped identification object 1 is installed and used in a slot machine (not shown). In other words, the device for identifying a coin-shaped identification object 1 is a device to identify authenticity and the like of the medal 2 thrown in from a medal inlet port of the slot machine. Then, in the following descriptions, the device for identifying a coin-shaped identification object 1, according to the present embodiment, is named as a "medal identification device 1."

The medal identification device 1 is provided with the case body 3, and a magnetic sensor 4 housed in the case body 3. Moreover, inside the medal identification device 1, there is formed a passage path 5 through which the medal 2 passes. The medal identification device 1 of the present embodiment is able to identify authenticity and good/bad condition of multiple types of the medal 2. Meanwhile, the medal 2 is formed of a metallic material. Incidentally, the medal 2 is formed so as to be disk-like.

The case body 3 is so formed as to be like a rectangular parallelepiped box. In one of side surfaces (a top surface shown in FIG. 1) of the case body 3, there is formed a slit-like passage hole 3*a* through which the medal 2 passes. In another side surface (a bottom surface shown in FIG. 1), which is in parallel with the side surface where the passage hole 3*a* is formed, there is also formed a passage hole through which the medal 2 passes. This passage hole and the passage hole 3*a* lead to the passage path 5. Incidentally, in the case body 3, there is fixed a guide element (not shown) for guiding the medal 2 to the passage path 3*a*.

The magnetic sensor 4 includes an exciting coil 8, detection coils 9 and 10, and a circular core 11 as a core body around which the exciting coil 8, and the detection coils 9 and 10 are wound. The circular core 11 is formed of a magnetic material. For example, the circular core 11 is formed of a ferrous magnetic material; such as ferrite, amorphous, permalloy, and the like. Incidentally, the circular core 11 is so formed as to be a flat plate. A concrete structure of the magnetic sensor 4 is explained below.

(Structure of the Magnetic Sensor)

Figure 3:
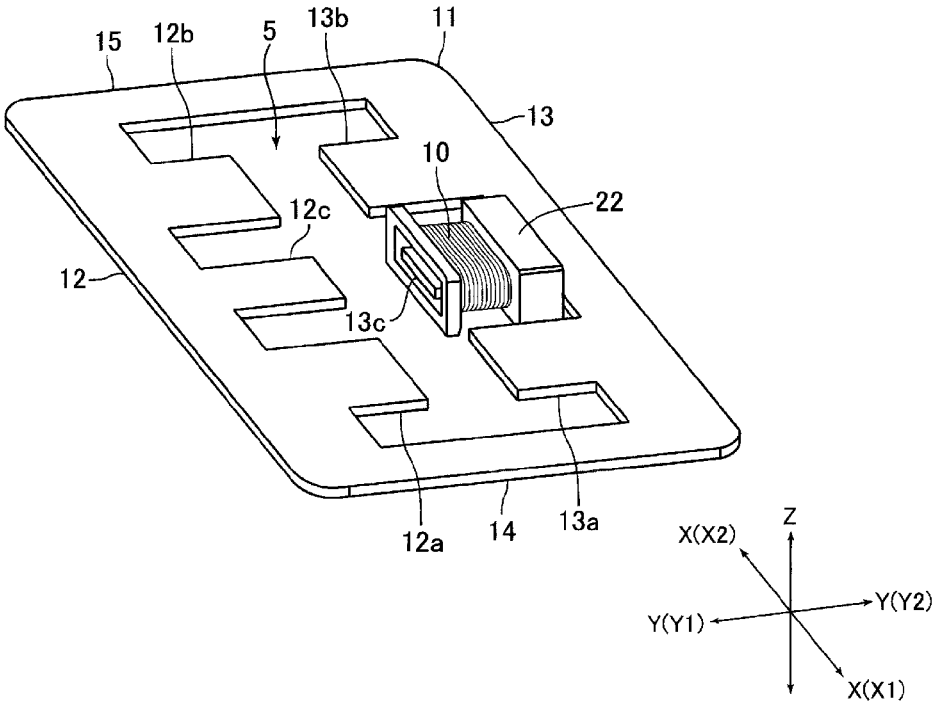
FIG. 3 is a perspective view showing a state where an exciting coil, a detection coil, and a bobbin have been removed under conditions shown in FIG. 2.
Figure 4:
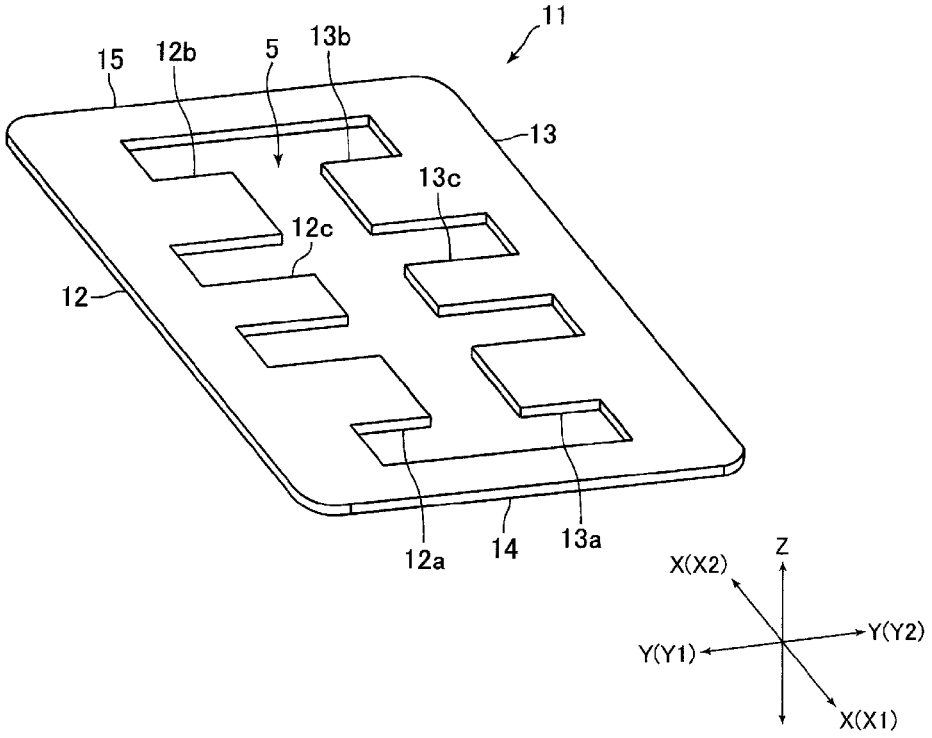
FIG. 4 is a perspective view of a circular core shown in FIG. 2.
Figure 5:
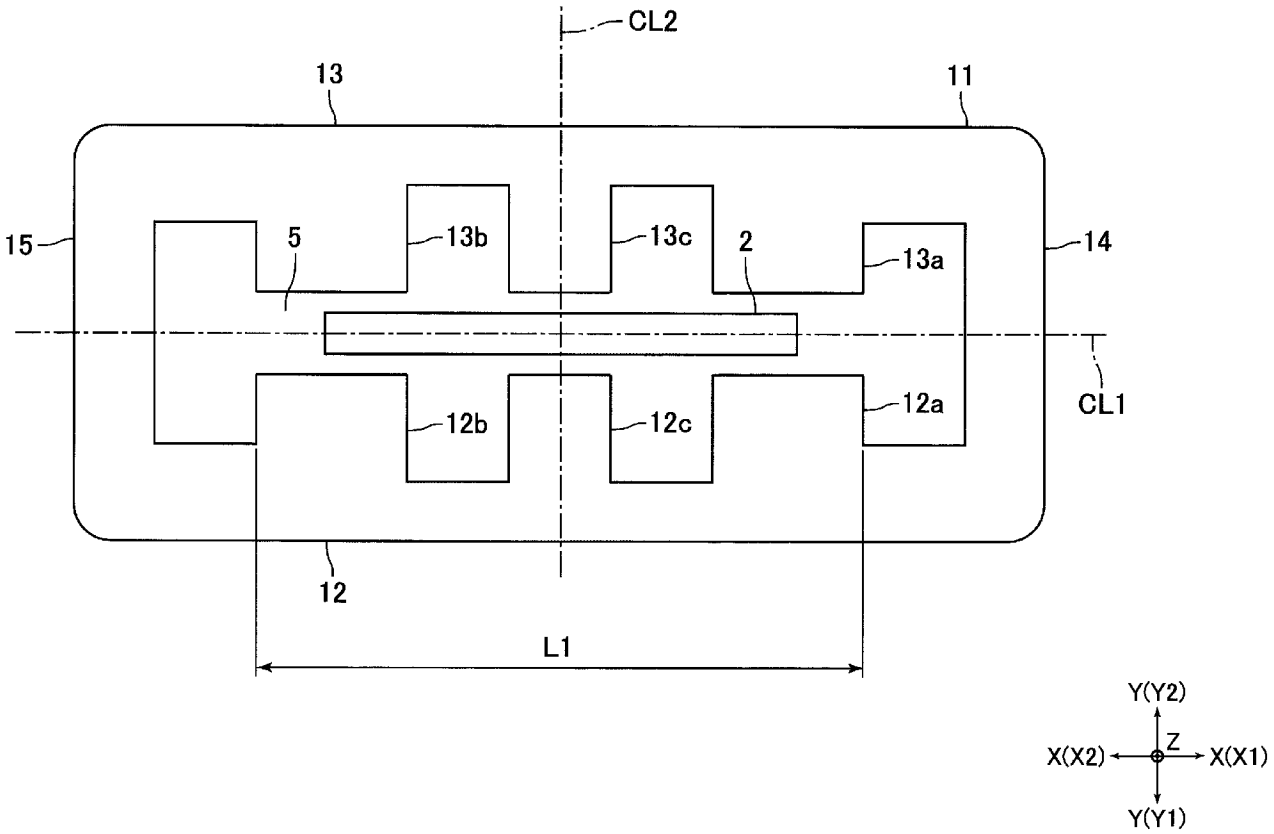
FIG. 5 is a plan view of a circular core shown in FIG. 2.

FIG. 3 is a perspective view showing a state where the exciting coil 8, the detection coil 9, and bobbins 20 and 21 have been removed under conditions shown in FIG. 2. FIG. 4 is a perspective view of the circular core 11 shown in FIG. 2. FIG. 5 is a plan view of the circular core 11 shown in FIG. 2.

In an explanation described below, three directions being at right angles one another are individually dealt with as an X-direction, a Y-direction, and a Z-direction; wherein the X-direction means a right-and-left direction, the Y-direction is a front-back direction, and the Z-direction represents a vertical direction. Moreover, an X1-direction side represents a right side, an X2-direction side is a left side, a Y1-direction means a front side, and a Y2-direction is a rear side. In the present embodiment, the magnetic sensor 4 is placed in such a way that a thickness direction of the circular core 11 is consistent with the vertical direction. Moreover, in the present embodiment, the medal 2 passes through the passage path 5 in the thickness direction of the circular core 11. In other words, the vertical direction is a passing direction of the medal 2 at a time when the medal 2 passes through the passage path 5, and the circular core 11 is placed in such a way that the passing direction of the medal 2 is consistent with the thickness direction of the circular core 11. Meanwhile, the front-back direction is a thickness direction of the medal 2 at a time when the medal 2 passes through the passage path 5.

As described above, the magnetic sensor 4 includes the exciting coil 8, the detection coils 9 and 10, and the circular core 11 as the core body around which the exciting coil 8, and the detection coils 9 and 10 are wound.

The circular core 11 is so formed as to be circular. Specifically to describe, the circular core 11 is formed as an almost-rectangular circle that is elongated in the right-and-left direction. The circular core 11 includes: an almost-linear first core 12 that makes up a front part of the circular core 11, and that is placed in parallel with the right-and-left direction; an almost-linear second core 13 that makes up a rear part of the circular core 11, and that is placed in parallel with the first core 12; a linear first connection core 14 that connects a right end of the first core 12 and a right end of the second core 13, and that is placed in parallel with the front-back direction; and a linear second connection core 15 that connects a left end of the first core 12 and a left end of the second core 13, and that is placed in parallel with the first connection core 14. The circular core 11 according to the present embodiment is made up by way of punching work by using a press machine; and the first core 12, the second core 13, the first connection core 14, and the second connection core 15 are made up as an all-in-one component. In other words, the circular core 11 is configured as one metal plate that is made up by way of press working.

The first core 12 and the second core 13 are so formed as to have an identical shape; and meanwhile, the first connection core 14 and the second connection core 15 are so formed as to have an identical shape. Moreover, as shown in FIG. 5, the circular core 11 is so formed as to have a line-symmetric shape with respect to a center line CL1, passing through a center position of the circular core 11 in the front-back direction, and being in parallel with the right-and-left direction; and to have a line-symmetric shape with respect to a center line CL2, passing through a center position of the circular core 11 in the right-and-left direction, and being in parallel with the front-back direction.

In the first core 12, there are formed protrusions 12*a*, 12*b*, and 12*c* that protrude toward the second core 13 (namely, protruding toward a back side). The protrusions 12*a*, 12*b*, and 12*c* are so shaped as to be rectangular. Rear end surfaces of the protrusions 12*a*, 12*b*, and 12*c* (namely, top end sections) are in parallel with the right-and-left direction, and meanwhile side-end sections at right and left side ends of the protrusions 12*a*, 12*b*, and 12*c* are in parallel with the front-back direction. In the meantime, the rear end surfaces of the protrusions 12*a*, 12*b*, and 12*c* are placed at the same plane being perpendicular to the front-back direction. The protrusion 12*a* is placed at a right end side, the protrusion 12*b* is placed at a left end side, and the protrusion 12*c* is placed between the protrusion 12*a* and the protrusion 12*b*. Specifically to describe, the protrusion 12*c* is placed in such a way that, in the right-and-left direction, a center of the protrusion 12*c* is consistent with a center of the first core 12; and in the meantime, the protrusions 12*a*, and 12*b* are placed at positions being line-symmetric with respect to the center line CL2 as a symmetry axis.

In the right-and-left direction, there is formed a clearance between the protrusion 12*a* and the first connection core 14, and there is formed a clearance between the protrusion 12*b* and the second connection core 15. Moreover, in the right-and-left direction, there is formed a clearance between the protrusion 12*a* and the protrusion 12*c*, and there is formed a clearance between the protrusion 12*b* and the protrusion 12*c*. The first core 12 is so shaped as to have a line-symmetric form with respect to the center line CL2. In the meantime, the clearance between the protrusion 12*a* and the first connection core 14 is sized to be the same as the clearance between the protrusion 12*b* and the second connection core 15, and the clearance between the protrusion 12*a* and the protrusion 12*c* is sized to be the same as the clearance between the protrusion 12*b* and the protrusion 12*c*.

Rear end surfaces of the first core 12, which are positioned between the protrusion 12*a* and the protrusion 12*c*, and between the protrusion 12*b* and the protrusion 12*c*, are located so as to be before rear end surfaces of the first core 12, which are positioned between the protrusion 12*a* and the first connection core 14, and between the protrusion 12*b* and the second connection core 15.

As described above, the second core 13 is so formed as to have an identical shape as the first core 12 has, and the second core 13 is placed at a position being line-symmetric with respect to the center line CL1 as a symmetry axis. Therefore, in the second core 13, there are formed protrusions 13*a*, 13*b*, and 13*c* that protrude toward the first core 12 (namely, protruding toward a front side). The protrusions 13*a*, 13*b*, and 13*c* are so formed as to have the same shape as the protrusions 12*a*, 12*b*, and 12*c* have; and front end surfaces of the protrusions 13*a*, 13*b*, and 13*c* (namely, top end sections) are placed at the same plane being perpendicular to the front-back direction.

In the right-and-left direction, the protrusion 13*a* is placed at the same position as the protrusion 12*a*, the protrusion 13*b* is placed at the same position as the protrusion 12*b*, and the protrusion 13*c* is placed at the same position as the protrusion 12*c*. In the same way as the first core 12 is, the second core 13 is so shaped as to have a line-symmetric form with respect to the center line CL2.

Furthermore, in the right-and-left direction, there is formed a clearance between the protrusion 13*a* and the first connection core 14; and between the protrusion 13*b* and the second connection core 15, there is formed a clearance, having the same size as the clearance between the protrusion 13*a* and the first connection core 14. Moreover, in the right-and-left direction, there is formed a clearance between the protrusion 13*a* and the protrusion 13*c*; and between the protrusion 13*b* and the protrusion 13*c*, there is formed a clearance, having the same size as the clearance between the protrusion 13*a* and the protrusion 13*c*. In the same way as the case of the first core 12, rear end surfaces of the second core 13, which are positioned between the protrusion 13*a* and the protrusion 13*c*, and between the protrusion 13*b* and the protrusion 13*c*, are located so as to be behind rear end surfaces of the second core 13, which are positioned between the protrusion 13*a* and the first connection core 14, and between the protrusion 13*b* and the second connection core 15.

A space between the protrusions 12*a*, 12*b*, and 12*c* and the protrusions 13*a*, 13*b*, and 13*c* in the front-back direction is provided as the passage path 5. The passage path 5 is shaped so as to be a rectangle being slender in the right-and-left direction. As described earlier, in the case body 3, there is fixed the guide element for guiding the medal 2 to the passage hole 3*a*. The guide element guides the medal 2 to the passage hole 3*a* in such a way that the medal 2 passes through between right end surfaces of the protrusions 12*a* and 13*a* and left end surfaces of the protrusions 12*b* and 13*b*. In other words, a distance L1 between the right end surfaces of the protrusions 12*a* and 13*a* and the left end surfaces of the protrusions 12*b* and 13*b* in the right-and-left direction (refer to FIG. 5) is equal to a width of the passage path 5 in the right-and-left direction. Moreover, the width of the passage path 5 in the right-and-left direction (namely, the distance L1) is greater than an outer diameter of the medal 2. Specifically to describe, the width of the passage path 5 in the right-and-left direction is greater than an outer diameter of the medal 2 that is expected to be thrown in from the medal inlet port of the slot machine, and that has the greatest outer diameter.

Meanwhile, the protrusions 12*c* and 13*c* are shaped and placed in such a way that an entire part of the protrusions 12*c* and 13*c* overlaps with the medal 2 in a view in the front-back direction, no matter where in the right-and-left direction the medal 2 passes through the passage path 5. In other words, the protrusions 12*c* and 13*c* are shaped and placed in such a way that the entire part of the protrusions 12*c* and 13*c* overlaps with the medal 2 in a view in the front-back direction, even at a time when the medal 2 passes through the passage path 5 in such a way that the right end surfaces of the protrusions 12*a* and 13*a*, or the left end surfaces of the protrusions 12*b* and 13*b* meet a circumferential edge of the metal 2.

The exciting coil 8 is wound around the protrusions 12*a*, 12*b*, and 12*c*. Concretely to describe, as shown in FIG. 2; the exciting coil 8 is wound around the protrusions 12*a*, 12*b*, and 12*c*, by the intermediary of a bobbin 20 that is almost like a square pipe covering both upper and lower surfaces of the protrusions 12*a*, 12*b*, and 12*c*, the right end surface of the protrusion 12*a*, and the left end surface of the protrusion 12*b*. In other words, the exciting coil 8 is wound around the protrusions 12*a*, 12*b*, and 12*c*, by the intermediary of a bobbin 20, so as to cover both the upper and lower surfaces of the protrusions 12*a*, 12*b*, and 12*c*, the right end surface of the protrusion 12*a*, and the left end surface of the protrusion 12*b*.

The detection coil 9 is wound around the protrusions 13*a*, 13*b*, and 13*c*. Concretely to describe, as shown in FIG. 2; the detection coil 9 is wound around the protrusions 13*a*, 13*b*, and 13*c*, by the intermediary of a bobbin 21 that is almost like a square pipe covering both upper and lower surfaces of the protrusions 13*a*, 13*b*, and 13*c*, the right end surface of the protrusion 13*a*, and the left end surface of the protrusion 13*b*. In other words, the detection coil 9 is wound around the protrusions 13*a*, 13*b*, and 13*c*, by the intermediary of a bobbin 21, so as to cover both the upper and lower surfaces of the protrusions 13*a*, 13*b*, and 13*c*, the right end surface of the protrusion 13*a*, and the left end surface of the protrusion 13*b*.

The detection coil 10 is wound around the protrusion 13*c*. Concretely to describe, as shown in FIG. 3; the detection coil 10 is wound around the protrusion 13*c*, by the intermediary of a bobbin 22 that is almost like a square pipe covering both the upper and lower surfaces, the right end surface, and the left end surface of the protrusion 13*c*. In other words, the detection coil 10 is wound around the protrusion 13*c*, by the intermediary of the bobbin 22, so as to cover both the upper and lower surfaces, the right end surface, and the left end surface of the protrusion 13*c*.

(Circuit Configuration of the Medal Identification Device)

Figure 6:
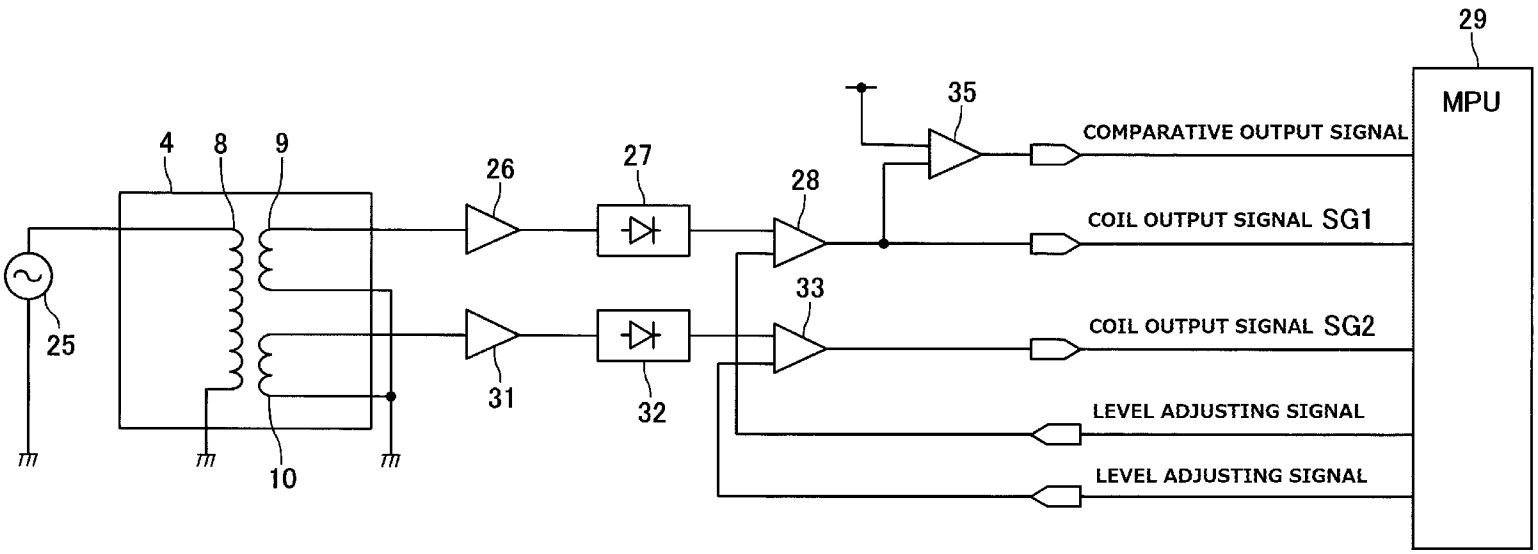
FIG. 6 is a circuit block diagram of a medal identification device shown in FIG. 1.
Figure 7A:
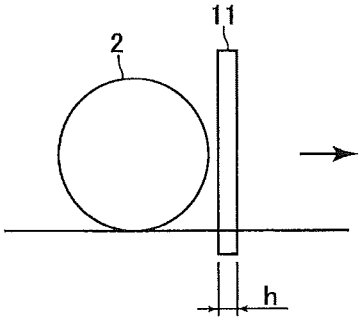
Figure 7B:
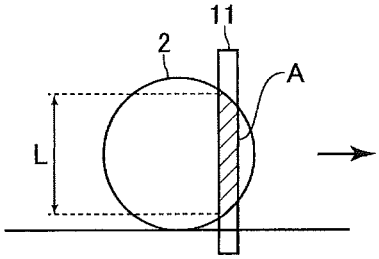
Figure 7C:
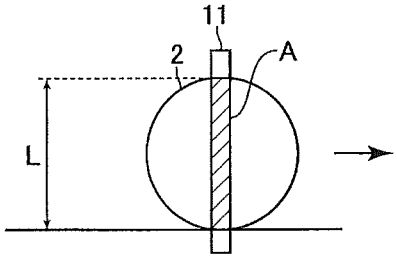
Figure 7D:
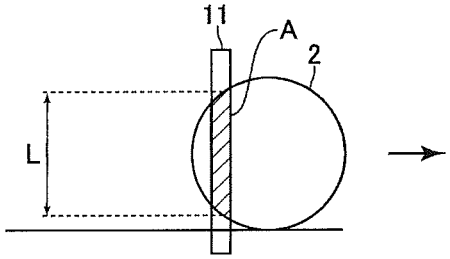
Figure 7D:
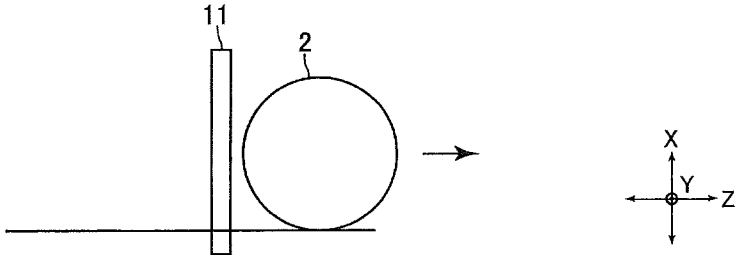
Figures 8A, 8B:
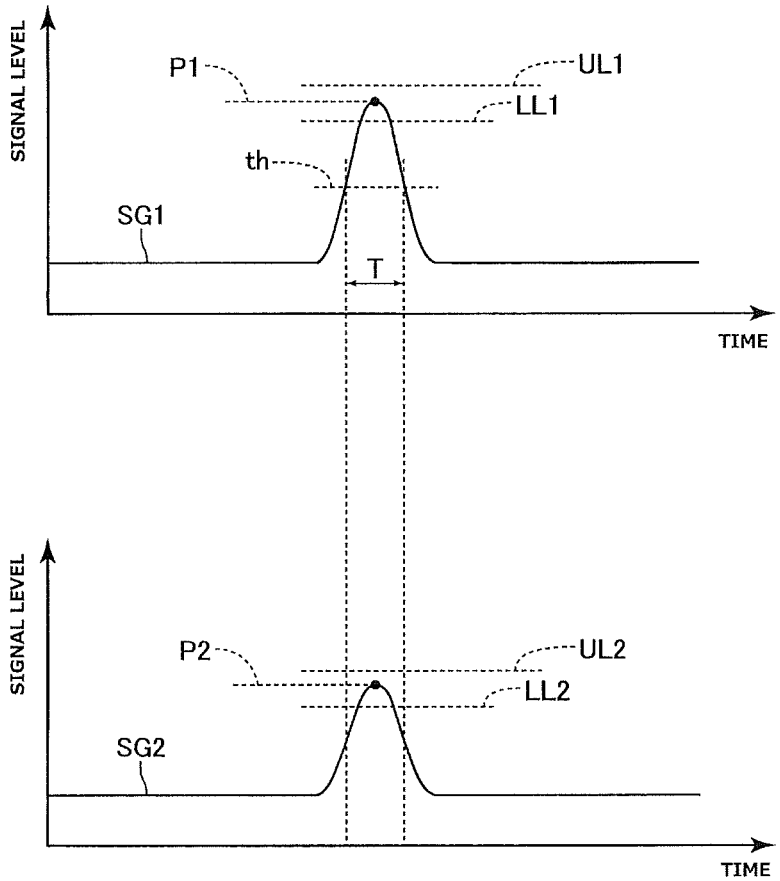
FIGS. 8A-8B are diagrams for explaining coil output signals created on the basis of an output from detection coils at the time when a medal passes through the circular core shown in FIG. 2.
Figure 9A:
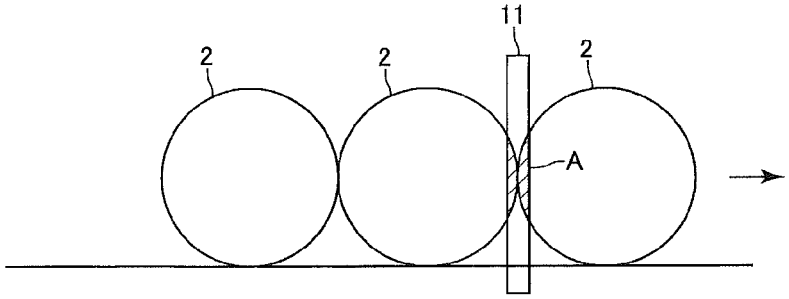
FIGS. 9A-9B are diagrams for explaining a state at a time when a plurality of medals continuously pass with no space between every two of the medals, through the circular core shown in FIG. 2.
Figure 9B:
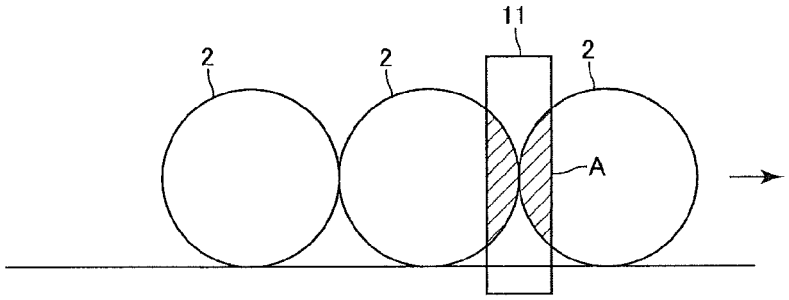
Figure 9B:
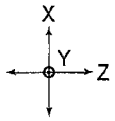
Figures 10A, 10B:
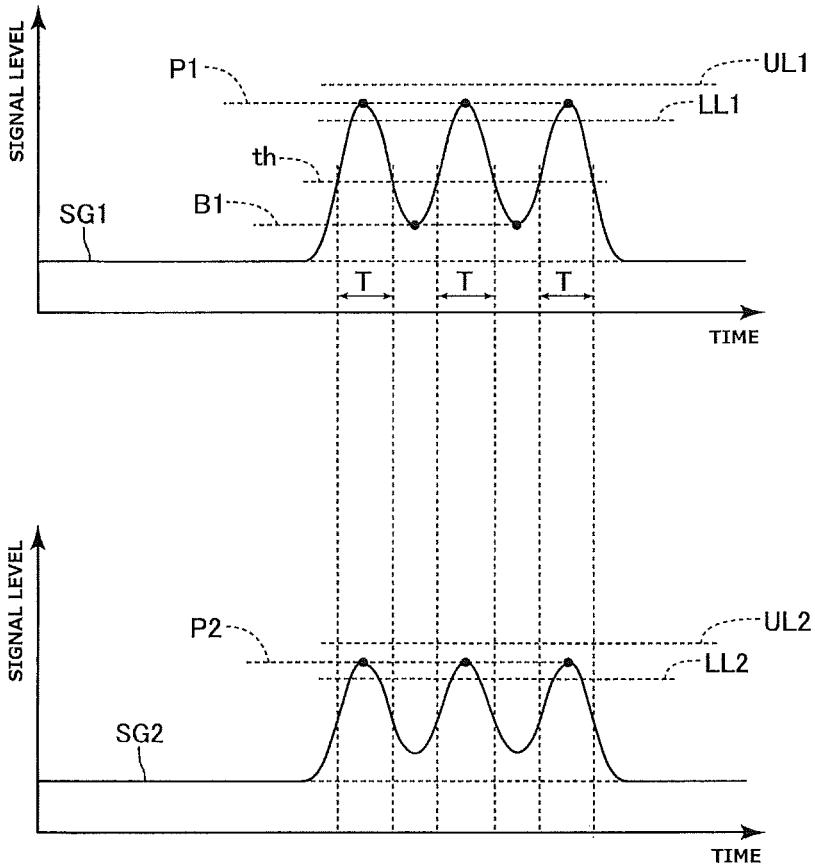
FIGS. 10A-10B are diagrams for explaining coil output signals created on the basis of an output from the detection coils at the time when a plurality of medals continuously pass with no space between every two of the medals, through the circular core shown in FIG. 2.

FIG. 6 is a circuit block diagram of the medal identification device 1 shown in FIG. 1. FIGS. 7A-7E are diagrams showing a state at a time when one medal 2 passes through the circular core 11 shown in FIG. 2. FIGS. 8A-8B are diagrams for explaining coil output signals SG1 and SG2 created on the basis of an output from the detection coils 9 and 10 at the time when one medal 2 passes through the circular core 11 shown in FIG. 2. FIGS. 9A-9B are diagrams showing a state at a time when a plurality of medals 2 continuously pass with no space between every two of the medals, through the circular core 11 shown in FIG. 2. FIGS. 10A-10B are diagrams for explaining coil output signals SG1 and SG2 created on the basis of an output from the detection coils 9 and 10 at the time when a plurality of medals 2 continuously pass with no space between every two of the medals, through the circular core 11 shown in FIG. 2.

As shown in FIG. 6, an AC power source 25 is connected to one end of an electrical lead constituting the exciting coil 8, and meanwhile the other end of the electrical lead constituting the exciting coil 8 is grounded. One end of an electrical lead constituting the detection coil 9 is connected to a micro processing unit (MPU) 29 as a control unit, by the intermediary of an amplifier circuit 26, a rectifier circuit 27, and a level adjusting circuit 28; and meanwhile, the other end of the electrical lead constituting the detection coil 9 is grounded. One end of an electrical lead constituting the detection coil 10 is connected to the MPU 29, by the intermediary of an amplifier circuit 31, a rectifier circuit 32, and a level adjusting circuit 33; and meanwhile, the other end of the electrical lead constituting the detection coil 10 is grounded. Between the level adjusting circuit 28 and the MPU 29, there is connected a comparator 35 in parallel.

In the magnetic sensor 4; at a time when the medal 2 passes through the passage path 5 under conditions where the exciting coil 8 generates an AC magnetic field inside the circular core 11 by use of an electric power supplied from the AC power source 25, the AC magnetic field inside the circular core 11 changes owing to an eddy-current loss. If once the AC magnetic field inside the circular core 11 changes, an output from the detection coil 9 and an output from the detection coil 10 change.

As described above, one end of the electrical lead constituting the detection coil 9 is connected to the MPU 29, by the intermediary of the amplifier circuit 26, the rectifier circuit 27, and the level adjusting circuit 28; and then, an analog coil output signal SG1 created on the basis of the output from the detection coil 9 is input from the level adjusting circuit 28 into the MPU 29. In the same way, one end of the electrical lead constituting the detection coil 10 is connected to the MPU 29, by the intermediary of the amplifier circuit 31, the rectifier circuit 32, and the level adjusting circuit 33; and then, an analog coil output signal SG2 created on the basis of the output from the detection coil 10 is input from the level adjusting circuit 33 into the MPU 29.

If the medal 2 passes through the passage path 5 under conditions where the exciting coil 8 generates an AC magnetic field, magnetic flux passing through the medal 2 decreases owing to an eddy current that occurs in the medal 2. Therefore, the decreased amount of magnetic flux passing through the medal 2 can be picked up as a change in a signal level of the coil output signal SG1 and the coil output signal SG2. In the present embodiment, a circuit of the medal identification device 1 is configured in such a way that; if the medal 2 passes through the passage path 5 under conditions where the exciting coil 8 generates an AC magnetic field, the signal level of the coil output signal SG1 and the coil output signal SG2 rises. Therefore, as shown in FIGS. 7A-7E; if one medal 2 passes through the passage path 5 (in other words, if the medal 2 passes through the circular core 11 constituting the magnetic sensor 4), for example, the coil output signal SG1 changing its signal level, as shown in FIG. 8A, is input into the MPU 29, and meanwhile the coil output signal SG2 changing its signal level, as shown in FIG. 8B, is input into the MPU 29.

Furthermore, in the case where a plurality of medals 2 continuously pass with no space between every two of the medals through the circular core 11; there appears an overlapping part of the circular core 11 and the medals 2, in a view in the front-back direction, even when a boundary part of two medals 2 passes through the circular core 11, as shown in FIGS. 9A-9B. Therefore, if the plurality of medals 2 continuously pass with no space between every two of the medals through the circular core 11, for example, the coil output signal SG1 changing its signal level, as shown in FIG. 10A, is input into the MPU 29, and meanwhile the coil output signal SG2 changing its signal level, as shown in FIG. 10B, is input into the MPU 29. In other words, when a signal level of the coil output signals SG1 and SG2, under a standby condition where no medal 2 passes through the circular core 11, is dealt with as a standby level; in the case where the plurality of medals 2 continuously pass with no space between every two of the medals through the circular core 11, a signal level rises up again before the signal level falls down to the standby level at a boundary between two medals 2, in the coil output signals SG1 and SG2 that are input into the MPU 29.

Furthermore, as described above, the distance L1 between the right end surfaces of the protrusions 12*a* and 13*a* and the left end surfaces of the protrusions 12*b* and 13*b* in the right-and-left direction is equal to the width of the passage path 5 in the right-and-left direction. Then, the detection coil 9 is wound around the protrusions 13*a*, 13*b*, and 13*c*, by the intermediary of a bobbin 21, in such a way as to cover both the upper and lower surfaces of the protrusions 13*a*, 13*b*, and 13*c*, the right end surface of the protrusion 13*a*, and the left end surface of the protrusion 13*b*. Accordingly, the signal level of the coil output signal SG1 on the basis of the output from the detection coil 9 varies owing to effects of a material, a thickness, and an outer diameter of the medal 2 passing through the circular core 11.

In the meantime, the protrusions 12*c* and 13*c* are placed between the protrusions 12*a* and 13*a*, and the protrusions 12*b* and 13*b*. Then, the protrusions 12*c* and 13*c* are shaped placed in such a way that the entire part of the protrusions 12*c* and 13*c* overlaps with the medal 2 in a view in the front-back direction, no matter where in the right-and-left direction the medal 2 passes through the passage path 5; and the detection coil 10 is wound around the protrusion 13*c*. Accordingly, the signal level of the coil output signal SG2 on the basis of the output from the detection coil 10 mainly varies owing to effects of a material and a thickness of the medal 2 passing through the circular core 11.

Incidentally, the signal level of the coil output signal SG1 sometimes varies owing to an effect of a change and the like in an ambient temperature around the medal identification device 1. According to the present embodiment, in order to prevent the signal levels of the coil output signals SG1 and SG2 from getting out of a measurable range of the MPU 29, even when a change and the like occur in the ambient temperature around the medal identification device 1, the signal levels of the coil output signals SG1 and SG2 are regularly adjusted. Concretely to describe, the level adjusting circuit 28 regularly adjusts the standby level of the coil output signal SG1 on the basis of a level adjusting signal, which is output from the MPU 29 and input into the level adjusting circuit 28 in accordance with the signal level of the coil output signal SG1. Meanwhile, the level adjusting circuit 33 regularly adjusts the standby level of the coil output signal SG2 on the basis of a level adjusting signal, which is output from the MPU 29 and input into the level adjusting circuit 33 in accordance with the signal level of the coil output signal SG2.

Then, in the present embodiment, the MPU 29 obtains a signal value of the coil output signals SG1 and SG2 at a time when the signal level of the coil output signal SG1 is equal to or higher than a predetermined threshold 'th'. Specifically to describe, at first the comparator 35 makes a comparison between the signal level of the coil output signal SG1 input from the level adjusting circuit 28 and the threshold 'th', and then outputs a digital output signal (a comparative output signal) SG5, based on a comparison result, to the MPU 29. More specifically to describe, the comparator 35 outputs a comparative output signal SG5, with which the signal level becomes "Hi" at a time when the signal level of the coil output signal SG1 is equal to or higher than the threshold 'th', and the signal level becomes "Lo" at a time when the signal level of the coil output signal SG1 is less than the threshold 'th'. Meanwhile, the MPU 29 obtains signal values of the coil output signals SG1 and SG2 within a range 'T' at a time when the signal level of the comparative output signal SG5 to be input is "Hi". In this way, the comparator 35 serves a function in determining a range for obtaining the signal values (a sampling range) of the coil output signals SG1 and SG2 in the MPU 29.

The threshold 'th' is specified in such a way that the signal level of the coil output signal SG1 intersects with the threshold 'th' at a time when each of the plurality of medals 2 passes through the circular core 11, as shown in FIG. 10A, for example, even in the case where the plurality of medals 2 continuously pass with no space between every two of the medals through the circular core 11, as shown in FIGS. 9A-9B. In other words, the threshold 'th' is specified in such a way that a bottom value B1 of the signal level of the coil output signal SG1 becomes lower than the threshold 'th', within a period after a center of the medal 2, which is one of the plurality of medals 2 continuously passing with no space between every two of the medals through the circular core 11, passes a center of the circular core 11, until a center of a next medal 2 passes the center of the circular core 11.

A material, a thickness, and a diameter of the medal 2 become diverse, depending on the type of the medal 2. Therefore, in accordance with the type of the medal 2 passing through the circular core 11, an eddy-current loss, at a time when the medal 2 passes through the circular core 11, changes. As a result of that, a peak value P1 of the signal level of the coil output signal SG1, and a peak value P2 of the signal level of the coil output signal SG2 change. Then, on the basis of the peak value P1 and the peak value P2, the MPU 29 determines whether or not the medal 2 passing through the circular core 11 is an authentic medal to be used in a slot machine in which the medal identification device 1 is installed. Specifically to describe, the MPU 29 judges that the medal 2 passing through the circular core 11 is an authentic medal, and the medal 2 is in good condition, in the case where the peak value P1 exists in a range between a predetermined upper limit value UL1 and a predetermined lower limit value LL1, and moreover the peak value P2 exists in a range between a predetermined upper limit value UL2 and a predetermined lower limit value LL2. On the other hand, it is judged that the medal 2 passing through the circular core 11 is a false medal, or the medal 2 is in bad condition, in the case where the peak value P1 exists outside the range between the upper limit value UL1 and the lower limit value LL1, or the peak value P2 exists outside the range between the upper limit value UL2 and the lower limit value LL2.

Incidentally, the medal identification device 1 according to the present embodiment is able to identify authenticity and good/bad condition of multiple types of the medal 2, as described above. Therefore, in the MPU 29, there are specified multiple combinations of the upper limit value UL1 and the lower limit value LL1, and the upper limit value UL2 and the lower limit value LL2, with respect to multiple types of the medal 2. The MPU 29 judges that the medal 2 passing through the circular core 11 is an authentic medal, and the medal 2 is in good condition, in the case where the peak value P1 exists in a range between a certain upper limit value UL1 and a certain lower limit value LL1, and moreover the peak value P2 exists in a range between an upper limit value UL2 and a lower limit value LL2, wherein the upper limit value UL2 and the lower limit value LL2 being in combination with the upper limit value UL1 and the lower limit value LL1.

(Thickness of the Circular Core)

Figure 11A:
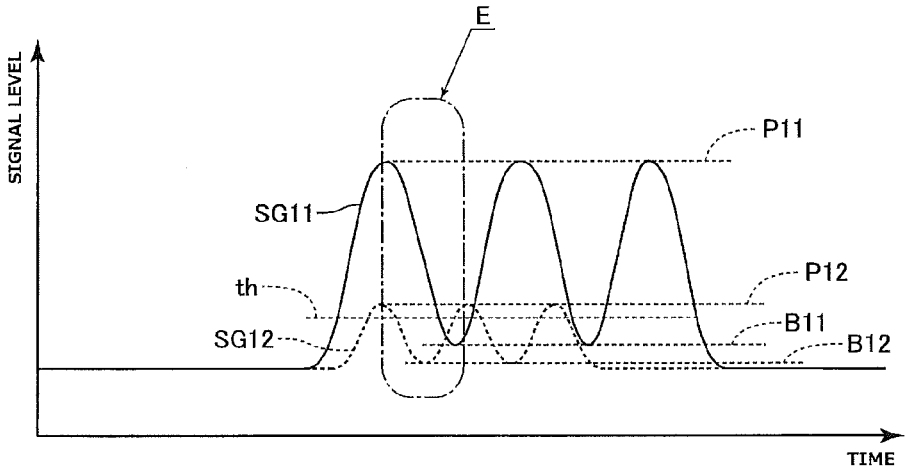
FIGS. 11A-11B are diagrams for explaining a relationship between a thickness of the circular core shown in FIG. 2 and a signal level of a coil output signal.
Figure 11B:
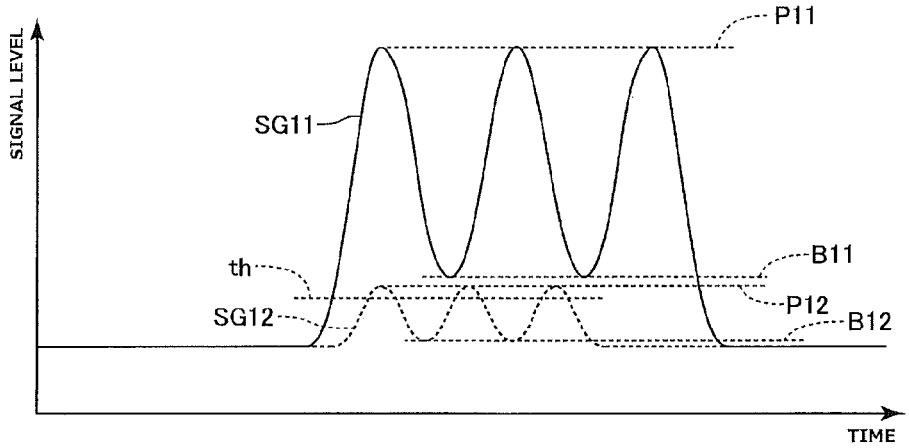

FIGS. 11A-11B is a diagram for explaining a relationship between a thickness of the circular core 11 shown in FIG. 2 and a signal level of the coil output signal SG1. FIGS. 12A-12B and FIGS. 13A-13B are diagrams for explaining a relationship between coil output signals SG11 through SG16, at a time when a plurality of medals 2 of multiple types, to be identified in the medal identification device 1 shown in FIG. 1, continuously pass with no space between every two of the medals through the circular core 11, and a thickness of the circular core 11.

As described above, the threshold 'th' is specified in such a way that the bottom value B1 of the signal level of the coil output signal SG1 becomes lower than the threshold 'th', at a time when each of the plurality of medals 2 passes through the circular core 11, as shown in FIG. 10A, even in the case where the plurality of medals 2 continuously pass with no space between every two of the medals through the circular core 11, as shown in FIGS. 9A-9B. Furthermore, as described above, the medal identification device 1 is able to identify authenticity and good/bad condition of multiple types of the medal 2. Therefore, the threshold 'th' is specified in such a way that the bottom value B1 of the coil output signal SG1 becomes lower than the threshold 'th', at a time when each of the plurality of medals 2 passes through the circular core 11, even in the case where any of the medals 2 of multiple types, to be identified as authentic medals 2 and those in good condition, continuously pass with no space between every two of the medals through the circular core 11.

As described above, if the medal 2 passes through the passage path 5 under conditions where the exciting coil 8 generates an AC magnetic field, magnetic flux passing through the medal 2 decreases owing to an eddy current that occurs in the medal 2. Therefore, the decreased amount of magnetic flux passing through the medal 2 can be picked up as a change in a signal level of the coil output signal SG1 and the coil output signal SG2. Where 'We' is a loss of an eddy current, occurring in the medal 2, per unit volume; 'L' is a width in the right-and-left direction of the overlapping part of the circular core 11 and the medals 2 (refer to FIGS. 7A-7E), in a view in the front-back direction at the time when the medal 2 passes through the passage path 5; 'ρ' is an electrical resistivity of the medal 2; 'BM' is a density of magnetic flux generated between the protrusions 12*a*, 12*b*, and 12*c* and the protrusions 13*a*, 13*b*, and 13*c* by the exciting coil 8; and 'f' is a frequency of the AC magnetic field generated by the exciting coil 8; the eddy-current loss 'We' is calculated according to a formula mentioned below:

$$We=\pi^2L^2f^2Bm^2/6\rho$$

Namely, the eddy-current loss 'We' is proportional to '($L^2/\rho$)' in theory, if the magnetic flux density 'Bm' and the frequency 'f' are constant. In this regard, the eddy-current loss 'We' is a loss per unit volume; and therefore, at a time of studying a change in the signal level of the coil output signals SG1 and SG2 owing to the eddy-current loss 'We', it is needed to take into account a volume of the medal 2 through which the magnetic flux passes. Accordingly, where 'h' is a thickness of the circular core 11 (a thickness in the vertical direction) (refer to FIGS. 7A-7E); 'A' is an area of a section of the medal 2 where the magnetic flux passes through (in other words, an area of the overlapping part of the circular core 11 and the medals 2 in a view in the front-back direction at the time when the medal 2 passes through the passage path 5) (refer to FIGS. 7A-7E and FIGS. 9A-9B); and 't' is a thickness of the medals 2; the signal level of the coil output signals SG1 and SG2 is proportional to a value mentioned below, in the case where a plurality of medals 2 continuously pass with no space between every two of the medals through the circular core 11.

$$(L^2/\rho)\ At=(L^2/\rho)\ Lht=L^3ht/\rho$$

Accordingly, if the thickness 'h' of the circular core 11 is constant, the signal level of the coil output signals SG1 and SG2 becomes high as a whole, when an outer diameter of the medal 2 is large, and the thickness of the medal 2 't' is thick, and the electrical resistivity 'ρ' is low, in the case where a plurality of medals 2 continuously pass with no space between every two of the medals through the circular core 11. On the other hand, the signal level of the coil output signals SG1 and SG2 becomes low as a whole, when the outer diameter of the medal 2 is small, and the thickness of the medal 2 't' is thin, and the electrical resistivity 'ρ' is high, in the case where a plurality of medals 2 continuously pass with no space between every two of the medals through the circular core 11.

In other words, if the thickness 'h' of the circular core 11 is constant, the peak value P1 of the coil output signal SG1 becomes high, when the outer diameter of the medal 2 is large, and the thickness of the medal 2 't' is thick, and the electrical resistivity 'ρ' is low, in the case where a plurality of medals 2 continuously pass with no space between every two of the medals through the circular core 11; and, to the contrary, the peak value P1 of the coil output signal SG1 becomes low, when the outer diameter of the medal 2 is small, and the thickness of the medal 2 't' is thin, and the electrical resistivity 'ρ' is high, in the case where a plurality of medals 2 continuously pass with no space between every two of the medals through the circular core 11. Moreover, if the thickness of the circular core 11 is constant, the bottom value B1 of the coil output signal SG1 becomes high, when the outer diameter of the medal 2 is large, and the thickness of the medal 2 't' is thick, and the electrical resistivity 'ρ' is low, in the case where a plurality of medals 2 continuously pass with no space between every two of the medals through the circular core 11; and, to the contrary, the bottom value B1 of the coil output signal SG1 becomes low, when the outer diameter of the medal 2 is small, and the thickness of the medal 2 't' is thin, and the electrical resistivity 'ρ' is high, in the case where a plurality of medals 2 continuously pass with no space between every two of the medals through the circular core 11.

Therefore, among medals 2 of multiple types, to be identified as authentic medals 2 and those in good condition; a medal 2 having a largest outer diameter, a thickest thickness of the thickness 't', and a lowest electrical resistivity of the electrical resistivity 'ρ' is dealt with as a first medal 2; and meanwhile, among medals 2 of multiple types, to be identified as authentic medals 2 and those in good condition; a medal 2 having a smallest outer diameter, a thinnest thickness of the thickness 't', and a highest electrical resistivity of the electrical resistivity 'ρ' is dealt with as a second medal 2. Then, among peak values P1 of coil output signals SG1 at a time when a plurality of medals 2 of multiple types, to be identified as authentic medals 2 and those in good condition, continuously pass with no space between every two of the medals through the circular core 11, a peak value P11 of a coil output signal SG11 (refer to FIGS. 11A-11B) becomes highest, in the case where a plurality of first medals 2 continuously pass with no space between every two of the medals through the circular core 11. Moreover, among bottom values B1 of the coil output signals SG1 at a time when a plurality of medals 2 of multiple types, to be identified as authentic medals 2 and those in good condition, continuously pass with no space between every two of the medals through the circular core 11, a bottom value B11 of the coil output signal SG11 becomes highest, in the case where the plurality of first medals 2 continuously pass with no space between every two of the medals through the circular core 11.

Furthermore, among the peak values P1 of the coil output signals SG1 at a time when a plurality of medals 2 of multiple types, to be identified as authentic medals 2 and those in good condition, continuously pass with no space between every two of the medals through the circular core 11, a peak value P12 of a coil output signal SG12 (refer to FIGS. 11A-11B) becomes lowest, in the case where a plurality of second medals 2 continuously pass with no space between every two of the medals through the circular core 11. Moreover, among the bottom values B1 of the coil output signals SG1 at a time when a plurality of medals 2 of multiple types, to be identified as authentic medals 2 and those in good condition, continuously pass with no space between every two of the medals through the circular core 11, a bottom value B12 of the coil output signal SG12 becomes lowest, in the case where the plurality of second medals 2 continuously pass with no space between every two of the medals through the circular core 11. In the present embodiment, the first medal 2 is a first identification object, and the second medal 2 is a second identification object. Incidentally, FIGS. 11A-11B show the coil output signals SG11 and SG12 in the case where the first medals 2 and the second medals 2 pass through the circular core 11.

Furthermore, in the case where a plurality of medals 2 continuously pass with no space between every two of the medals through the circular core 11, the signal level of the coil output signals SG1 and SG2 is proportional to '($L^3ht/\rho$)' so that the signal level changes according to the thickness 'h' of the circular core 11 as well. Concretely to describe, when the thickness 'h' of the circular core 11 becomes thick, the signal level of the coil output signals SG1 and SG2 becomes high as a whole, in the case where a plurality of medals 2 continuously pass with no space between every two of the medals through the circular core 11. Therefore, if the outer diameter, the thickness 't', and the electrical resistivity 'ρ' of the medal 2 are constant, the peak value P1 of the coil output signal SG1 becomes higher, as the thickness 'h' of the circular core 11 becomes thicker, in the case where a plurality of medals 2 continuously pass with no space between every two of the medals through the circular core 11; and to the contrary, the peak value P1 of the coil output signal SG1 becomes lower, as the thickness 'h' of the circular core 11 becomes thinner, in the case where a plurality of medals 2 continuously pass with no space between every two of the medals through the circular core 11. Moreover, if the outer diameter, the thickness 't', and the electrical resistivity 'ρ' of the medal 2 are constant, the bottom value B1 of the coil output signal SG1 becomes higher, as the thickness 'h' of the circular core 11 becomes thicker, in the case where a plurality of medals 2 continuously pass with no space between every two of the medals through the circular core 11; and to the contrary, the bottom value B1 of the coil output signal SG1 becomes lower, as the thickness 'h' of the circular core 11 becomes thinner, in the case where a plurality of medals 2 continuously pass with no space between every two of the medals through the circular core 11. Incidentally, the peak value P1 of the coil output signal SG1, in the case where a plurality of medals 2 continuously pass with no space between every two of the medals through the circular core 11, is the same as the peak value P1 of the coil output signal SG1, in the case where only one medal 2, being the same as the above medals 2, passes through the circular core 11.

In the meantime, as described above, the threshold 'th' is specified in such a way that the bottom value B1 becomes lower than the threshold 'th', at a time when each of the plurality of medals 2 passes through the circular core 11, even in the case where any of the medals 2 of multiple types, to be identified as authentic medals 2 and those in good condition, continuously pass with no space between every two of the medals through the circular core 11. If the thickness 'h' of the circular core 11 is so specified as to be a predetermined thickness, and the bottom value B11, at a time when the plurality of first medals 2 continuously pass with no space between every two of the medals through the circular core 11, is lower than the peak value P12, at a time when the second medals 2 pass through the circular core 11, as shown in FIG. 11A, the threshold 'th' can be specified in such a way that the bottom value B11 is lower than the threshold 'th', and the peak value P12 is higher than the threshold 'th'. In other words, the threshold 'th' can be specified in such a way that the bottom value B1 becomes lower than the threshold 'th', at a time when each of the plurality of medals 2 passes through the circular core 11, even in the case where any of the medals 2 of multiple types, to be identified as authentic medals 2 and those in good condition, continuously pass with no space between every two of the medals through the circular core 11; and moreover, the peak value P1 of the coil output signal SG1 becomes higher than the threshold 'th', even in the case where any of the medals 2 of multiple types, to be identified as authentic medals 2 and those in good condition, pass through the circular core 11.

On the other hand, if the thickness 'h' of the circular core 11 becomes so thick that the bottom value B11, at a time when the plurality of first medals 2 continuously pass with no space between every two of the medals through the circular core 11, is higher than the peak value P12, at a time when the second medals 2 pass through the circular core 11, as shown in FIG. 11B, the threshold 'th' cannot be specified in such a way that the bottom value B11 is lower than the threshold 'th', and the peak value P12 is higher than the threshold 'th'. In other words, the threshold 'th' cannot be specified in such a way that the bottom value B1 becomes lower than the threshold 'th', at a time when each of the plurality of medals 2 passes through the circular core 11, even in the case where any of the medals 2 of multiple types, to be identified as authentic medals 2 and those in good condition, continuously pass with no space between every two of the medals through the circular core 11; and moreover, the peak value P1 of the coil output signal SG1 becomes higher than the threshold 'th', even in the case where any of the medals 2 of multiple types, to be identified as authentic medals 2 and those in good condition, pass through the circular core 11.

Then, in the present embodiment; wherein a first thickness 'h1' represents the thickness 'h' in the case where the bottom value B11, at a time when the first medals 2 continuously pass with no space between every two of the medals through the circular core 11, is equal to the peak value P12, at a time when the second medals 2 pass through the circular core 'h1'. the thickness 'h' of the circular core 11 is less than the thickness 'h1'. In the present embodiment, an outer diameter of the medals 2 of multiple types, to be identified as authentic medals 2 and those in good condition, is equal to or greater than 20 mm and equal to or smaller than 30 mm; a thickness of the medals 2 of multiple types, to be identified as authentic medals 2 and those in good condition, is equal to or thicker than 1.3 mm and equal to or thinner than 2.5 mm; and a material of the medals 2 of multiple types, to be identified as authentic medals 2 and those in good condition, is one of stainless steel (more specifically, SUS304), brass, bronze, and cupronickel; and then the thickness 'h' of the circular core 11 is less than 1.2 mm. Meanwhile, the thickness 'h' of the circular core 11 is calculated as described below.

More specifically, at first, among the materials for the medals 2 of multiple types, to be identified as authentic medals 2 and those in good condition, the stainless steel has a highest electrical resistivity ($p=72\times10^{-8}$ (Ωm)), and meanwhile the brass has a lowest electrical resistivity (ρ=5 through $7\times10^{-8}$ (Ωm)). Therefore, in the present embodiment, the first medal 2 is a medal 2 made of brass, having an outer diameter of 30 mm, and a thickness of 2.5 mm. In the meantime, the second medal 2 is a medal 2 made of stainless steel, having an outer diameter of 20 mm, and a thickness of 1.3 mm. Then, a simulation is carried out in order to obtain the coil output signals SG11 and SG12 under conditions where a plurality of first medals 2 and second medals 2 continuously pass with no space between every two of the medals through the circular core 11, while changing the thickness 'h' of the circular core 11. As a result, the coil output signals SG11 and SG12, changing their signal levels as shown in FIGS. 12A-12B and FIGS. 13A-13B, are obtained.

Figure 12A:
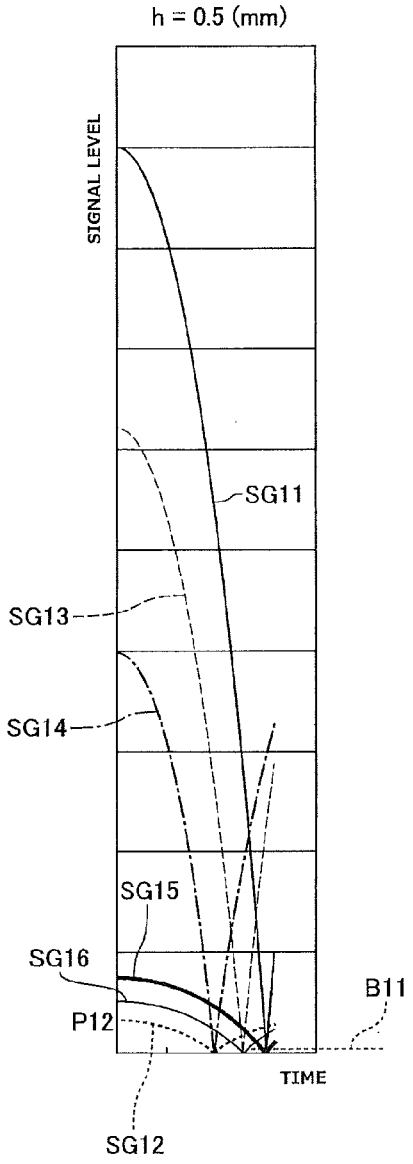
FIGS. 12A-12B are diagrams for explaining a relationship between a coil output signal, at a time when a plurality of medals of multiple types to be identified in the medal identification device shown in FIG. 1 continuously pass with no space between every two of the medals through the circular core, and a thickness of the circular core.
Figure 12B:
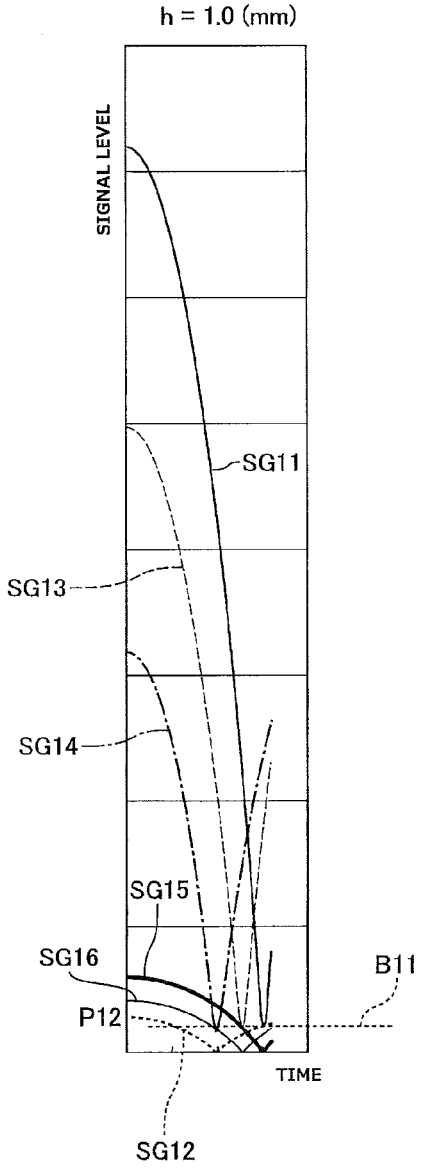
Figure 13A:
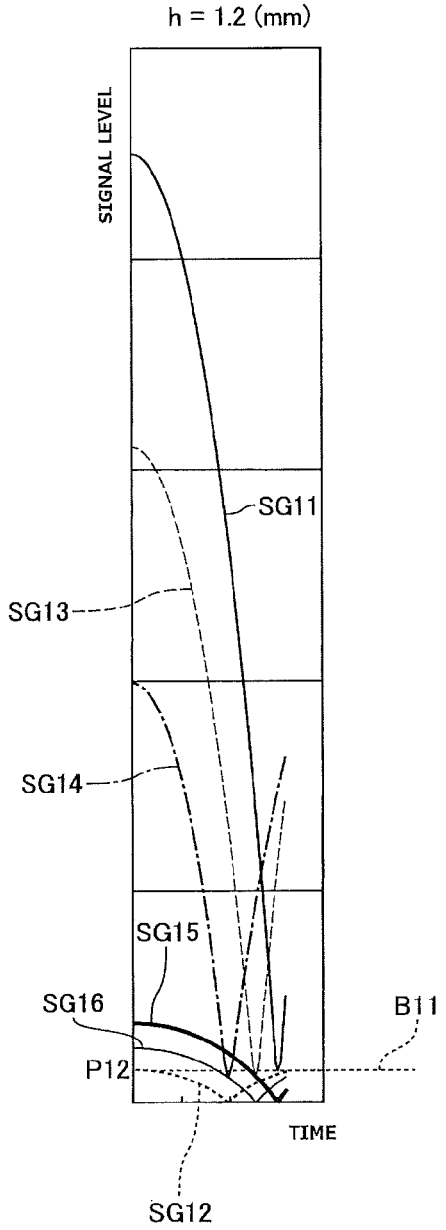
FIGS. 13A-13B are diagrams for explaining a relationship between a coil output signal, at a time when a plurality of medals of multiple types to be identified in the medal identification device shown in FIG. 1 continuously pass with no space between every two of the medals through the circular core, and a thickness of the circular core.
Figure 13B:
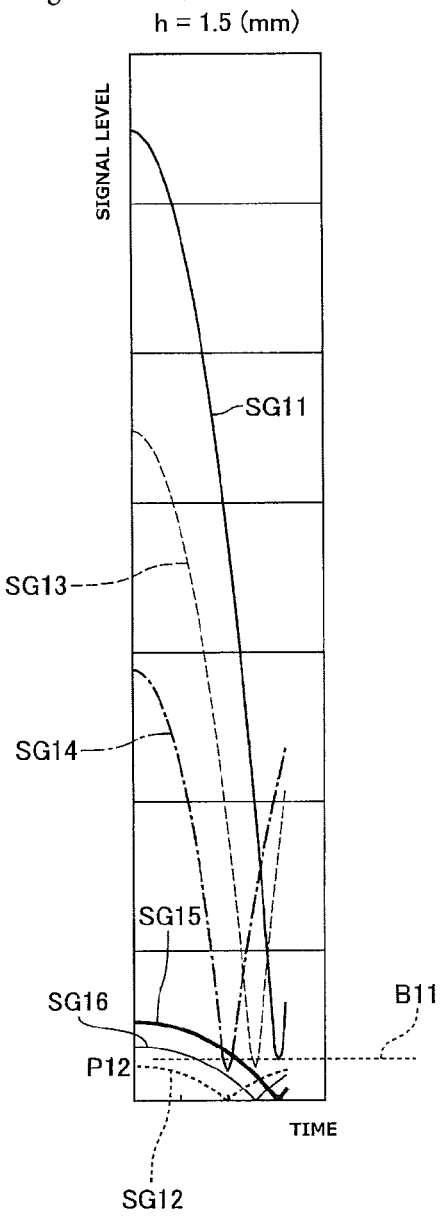

FIG. 12A shows the coil output signals SG11 and SG12 in the case of a thickness 'h' of the circular core 11 of 0.5 mm, FIG. 12B shows the coil output signals SG11 and SG12 in the case of a thickness 'h' of the circular core 11 of 1.0 mm, FIG. 13A shows the coil output signals SG11 and SG12 in the case of a thickness 'h' of the circular core 11 of 1.2 mm, and FIG. 13B shows the coil output signals SG11 and SG12 in the case of a thickness 'h' of the circular core 11 of 1.5 mm.

Incidentally, FIGS. 12A-12Band FIGS. 13A-13B each show a part corresponding to a section 'E' shown in FIG. 11A. Moreover, FIGS. 12A-12B and FIGS. 13A-13B each show; a coil output signal SG13 that is the coil output signal SG1 at a time when medals 2 made of brass, having an outer diameter of 25 mm, and a thickness of 2.5 mm continuously pass with no space between every two of the medals through the circular core 11; a coil output signal SG14 that is the coil output signal SG1 at a time when medals 2 made of brass, having an outer diameter of 20 mm, and a thickness of 2.5 mm continuously pass with no space between every two of the medals through the circular core 11; a coil output signal SG15 that is the coil output signal SG1 at a time when medals 2 made of stainless steel, having an outer diameter of 30 mm, and a thickness of 1.3 mm continuously pass with no space between every two of the medals through the circular core 11; and a coil output signal SG16 that is the coil output signal SG1 at a time when medals 2 made of stainless steel, having an outer diameter of 25 mm, and a thickness of 1.3 mm continuously pass with no space between every two of the medals through the circular core 11. Meanwhile, FIGS. 12A-12B and FIGS. 13A-13B show the coil output signals SG11 through SG16 in the case of each of the medals 2 passes through the circular core 11 at the same speed. In addition, as the thickness 'h' of the circular core 11 becomes thicker in FIGS. 12A-12B and FIGS. 13A-13B, a degree of scale reduction for the signal level (in the vertical axis) of the coil output signals SG11 through SG16 is set greater.

As shown in FIGS. 12A-12B, when the thickness 'h' of the circular core 11 is 0.5 mm and 1.0 mm, the bottom value B11 is lower than the peak value P12. Meanwhile, as shown in FIG. 13A, when the thickness 'h' of the circular core 11 is 1.2 mm, the bottom value B11 is equal to the peak value P12. As shown in FIG. 13B, when the thickness 'h' of the circular core 11 is 1.5 mm, the bottom value B11 is higher than the peak value P12. Therefore, if the thickness 'h' of the circular core 11 is thinner than 1.2 mm, the threshold 'th' can be specified in such a way that the bottom value B1 becomes lower than the threshold 'th', at a time when each of the plurality of medals 2 passes through the circular core 11, even in the case where any of the medals 2 of multiple types, to be identified as authentic medals 2 and those in good condition, continuously pass with no space between every two of the medals through the circular core 11; and moreover, the peak value P1 of the coil output signal SG1 becomes higher than the threshold 'th', even in the case where any of the medals 2 of multiple types, to be identified as authentic medals 2 and those in good condition, pass through the circular core 11. Therefore, the thickness 'h' of the circular core 11 is thinner than 1.2 mm in the present embodiment. In other words, the first thickness 'h1' is specified to be 1.2 mm.

The thinner the thickness 'h' of the circular core 11 is, the lower the bottom value B11 becomes, and therefore the threshold 'th' can be specified easily. On the other hand, if the thickness 'h' of the circular core 11 is excessively thin, it becomes difficult to handle the circular core 11 at the time of manufacturing the medal identification device 1. Moreover, a predetermined thermal treatment process is needed for the circular core 11 that generate a magnetic path, and therefore in the case where the thickness 'h' of the circular core 11 is excessively thin, there increases a risk of the circular core 11 being deformed at the time of the thermal treatment process. Accordingly, the thickness 'h' of the circular core 11 according to the present embodiment is 0.5 mm in consideration of those factors. Incidentally, the thickness 'h' of the circular core 11 may be around 0.1 mm as well.

(Primary Advantageous Effect of the Present Embodiment)

As explained above, in the present embodiment, the MPU 29 obtains the signal values of the coil output signals SG1 and SG2, at the time when the signal level of the coil output signal SG1 is equal to or higher than the threshold 'th'. Therefore, in comparison with a case where a signal value of the coil output signals SG1 and SG2 is obtained at a constant sampling period, regardless of the signal level of the coil output signal SG1; the amount of data of the signal values, which the MPU 29 obtains and handles, can be reduced in the present embodiment, so that the handling process in the MPU 29 can be simplified. Therefore, according to the present embodiment, it becomes possible to speed up the handling process in the MPU 29; and as a result, the medals 2 can be identified at high speed. Furthermore, in the present embodiment, since the MPU 29 obtains the signal values of the coil output signals SG1 and SG2, at the time when the signal level of the coil output signal SG1 is equal to or higher than the threshold 'th', the peak values P1 and P2 of the coil output signals SG1 and SG2 can be obtained for sure, even though the speed of the medals 2 passing through the circular core 11 fluctuates.

According to the present embodiment, the thickness 'h' of the circular core 11 is thinner than the thickness 'h1' in the case where the bottom value B11 of the coil output signals SG11, at a time when the first medals 2 continuously pass with no space between every two of the medals through the circular core 11, is equal to the peak value P12 of the coil output signals SG12, at a time when the second medals 2 pass through the circular core 11; wherein the first medals 2 having the largest outer diameter, the thickest thickness of the thickness 't' , and the lowest electrical resistivity of the electrical resistivity 'ρ' among the medals 2 of multiple types, to be identified as authentic medals 2 and those in good condition, and the second medals 2 having the smallest outer diameter, the thinnest thickness of the thickness T, and the highest electrical resistivity of the electrical resistivity 'ρ' among the medals 2 of multiple types, to be identified as authentic medals 2 and those in good condition. Therefore, according to the present embodiment as described above, the threshold 'th' can be specified in such a way that the bottom value B1 of the signal level of the coil output signal SG1 becomes lower than the threshold 'th', at a time when each of the plurality of medals 2 passes through the circular core 11, even in the case where any multiple medals 2 among the medals 2 of multiple types, to be identified as authentic medals 2 and those in good condition, continuously pass with no space between every two of the medals through the circular core 11; and moreover, the peak value P1 of the signal level of the coil output signal SG1 becomes higher than the threshold 'th', even in the case where any of the medals 2 of multiple types, to be identified as authentic medals 2 and those in good condition, pass through the circular core 11.

Therefore, according to the present embodiment; even though authenticity and good/bad condition of multiple types of the medal 2 can be identified, and moreover even in the case where a plurality of medals 2 continuously pass with no space between every two of the medals through the circular core 11; the amount of data of the signal values, which the MPU 29 obtains and handles, can be reduced so that the handling process of the MPU 29 can be simplified. Then, according to the present embodiment; even though authenticity and good/bad condition of multiple types of the medal 2 can be identified, and moreover even in the case where a plurality of medals 2 continuously pass with no space between every two of the medals through the circular core 11; it becomes possible to speed up the handling process of the MPU 29; and as a result, the medals 2 can be identified at high speed.

Furthermore, according to the present embodiment; since the threshold 'th' can be specified in such a way that the bottom value B1 of the signal level of the coil output signal SG1 becomes lower than the threshold 'th', at a time when each of the plurality of medals 2 passes through the circular core 11, it becomes possible to obtain the signal value of the coil output signal SG1 of each of the medals 2, at a predetermined time interval, even in the case where the plurality of medals 2 continuously pass with no space between every two of the medals through the circular core 11. Therefore, according to the present embodiment, it becomes possible to appropriately identify authenticity and good/bad condition of each of the plurality of medals 2 on the basis of the obtained signal value of the coil output signal SG1, even in the case where the plurality of medals 2 continuously pass with no space between every two of the medals through the circular core 11. Furthermore, according to the present embodiment, it becomes possible to easily calculate the number of the medals 2 passing through the circular core 11.

(Other Embodiments)

Described above is an example of an embodiment according to the present invention. Incidentally, the present invention is not limited to the above embodiment and various variations and modifications may be made without changing the concept of the present invention.

In the embodiment described above, although the medal identification device 1 is a device to identify authenticity of the medal 2 and to identify good/bad condition of the medal 2 being authentic, the medal identification device 1 may carry out only one of identifying authenticity of the medal 2, and identifying good/bad condition of the medal 2 being authentic.

In the embodiment described above, although the outer diameter of the medals 2 of multiple types, to be identified as authentic medals 2 and those in good condition, is equal to or greater than 20 mm, and equal to or smaller than 30 mm, the outer diameter of the medals 2 of multiple types, to be identified as authentic medals 2 and those in good condition, may be smaller than 20 mm or greater than 30 mm. For example, the outer diameter of the medals 2 of multiple types, to be identified as authentic medals 2 and those in good condition, may be equal to or greater than 20 mm, and equal to or smaller than 32 mm. Meanwhile, in the embodiment described above, although the thickness 't' of the medals 2 of multiple types, to be identified as authentic medals 2 and those in good condition, is equal to or thicker than 1.3 mm, and equal to or thinner than 2.5 mm, alternatively the thickness 't' of the medals 2 of multiple types, to be identified as authentic medals 2 and those in good condition, may be thinner than 1.3 mm or thicker than 2.5 mm.

In the embodiment described above, although the material of the medals 2 of multiple types, to be identified as authentic medals 2 and those in good condition, is one of stainless steel, brass, bronze, and cupronickel; instead of these materials, or in addition to these materials, another material may be used, as a material for the medals 2 of multiple types, to be identified as authentic medals 2 and those in good condition. For example, the material of the medals 2 of multiple types, to be identified as authentic medals 2 and those in good condition, may be one of stainless steel, brass, bronze, cupronickel, and aluminum alloy.

In the embodiment described above, the MPU 29 obtains the signal values of the coil output signals SG1 and SG2, at the time when the signal level of the coil output signal SG1 is equal to or higher than the threshold 'th'. Alternatively, for example, the MPU 29 may obtain the signal values of the coil output signals SG1 and SG2, at a time when the signal level of the coil output signal SG2 is equal to or higher than a predetermined threshold. In this case, the thickness 'h' of the circular core 11 is thinner than a thickness 'h' in the case where a bottom value of the signal level of the coil output signals SG2, at a time when the first medals 2 continuously pass with no space between every two of the medals through the circular core 11, is equal to a peak value of the coil output signals SG2, at a time when the second medals 2 pass through the circular core 11.

In the embodiment described above, the circuit of the medal identification device 1 is configured in such a way that the signal level of the coil output signals SG1 and SG2 rises at the time when the medal 2 passes through the passage path 5 under conditions where the exciting coil 8 generates an AC magnetic field. Alternatively, for example, the circuit of the medal identification device 1 may be configured in such a way that the signal level of the coil output signals SG1 and SG2 falls at the time when the medal 2 passes through the passage path 5 under conditions where the exciting coil 8 generates an AC magnetic field. In this case, the signal values of the coil output signals SG1 and SG2 are obtained, at a time when the signal level of the coil output signal SG1 is equal to or lower than a predetermined threshold.

Furthermore, in this case, the thickness 'h' of the circular core 11 is so specified as to be thinner than a thickness 'h' in the case where a peak value at a time when the first medals 2 continuously pass with no space between every two of the medals through the circular core 11, is equal to a bottom value at a time when the second medals 2 pass through the circular core 11. In this case, the threshold 'th' can be specified in such a way that the peak value of the signal level of the coil output signal SG1 becomes higher than the threshold, at a time when each of the plurality of medals 2 passes through the circular core 11, even in the case where any multiple medals 2 among the medals 2 of multiple types, to be identified as authentic medals 2 and those in good condition, continuously pass with no space between every two of the medals through the circular core 11; and moreover, the bottom value of the signal level of the coil output signal SG1 becomes lower than the threshold 'th', even in the case where any of the medals 2 of multiple types, to be identified as authentic medals 2 and those in good condition, pass through the circular core 11. Accordingly, the same effect, as the embodiment described above brings about, can be obtained.

In the embodiment described above, the magnetic sensor 4 is provided with the detection coils 9 and 10. Alternatively, for example, the number of detection coils, with which the magnetic sensor 4 is provided, may be one, or three or more. In this case, a requirement is to form protrusions in the second core 13, in accordance with the number of detection coils.

In the embodiment described above, the circular core 11 is configured as one metal plate that is made up by way of press working. Alternatively, for example, the circular core 11 may be configured with a metallic foil formed with a magnetic material, and a thin reinforcing plate made of a resin material, on which the metallic foil is attached. In this case, the metallic foil attached onto the reinforcing plate works as a core body. Incidentally, a thickness of the metallic foil working as the core body is, for example, 15 microns.

In the embodiment described above, the magnetic sensor 4 is provided with the circular core 11 formed so as to be circular. Alternatively, for example, the magnetic sensor 4 may be provided with a core body, instead of the circular core 11; while, in the core body, a gap (a slit) being formed in, at least one of the first core 12, the second core 13, the first connection core 14, and the second connection core 15.

In this case, the gap may be filled with a non-magnetic material. Furthermore, in the embodiment described above, the circular core 11 is formed as an almost-rectangular circle. Alternatively, the circular core 11 may be formed as a circular ring, an elliptical ring, or an elongated circular ring. Moreover, the circular core 11 may be formed as a polygonal circular ring, other than a rectangular circle.

In the embodiment described above, the medal identification device 1 is installed and used in a slot machine. Alternatively, the medal identification device 1 may be installed and used, for example, in a medal vending machine, or a medal counting machine. Moreover, in the embodiment described above, a working example of the device for identifying a coin-shaped identification object according to at least an embodiment of the present invention is explained, by using the medal identification device 1 for identifying the medal 2 to be used in a slot machine, as an example. Alternatively, the device for identifying a coin-shaped identification object, to which at least an embodiment of the present invention is applied, may be a device for identifying another type of coin-shaped identification object, for example, such as a medal to be used for a game machine. Moreover, the coin-shaped identification object in the present invention is not limited to a medal to be used in a slot machine, a game machine, and the like; and the coin-shaped identification object may be a coin as well. Incidentally, a medal vending machine is a device from which a medal is purchased by paying cash, and such a medal vending machine is placed between slot machines, or at an entrance of a hall. In the meantime, a medal counting machine is a device for counting the number of medals collected from each slot machine. In the case of such a medal counting machine, for example, one machine is installed for a certain number slot machines (for example, being installed for each group of slot machines), in order to count the number of medals 2 collected from a plurality of slot machines constituting the group for which the medal counting machine is installed. Moreover, a medal counting machine is, for example, a total collective handling machine for counting medals 2 that are collected within each group of machines and further collected from multiple groups. Furthermore, a medal counting machine is, for example, a device that counts medals 2 in order to exchange the medals for a premium.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A device for identifying a coin-shaped identification object to identify authenticity and/or condition of a coin-shaped identification object of multiple types, the device comprising:

a passage path, through which the identification object passes through;

an exciting coil and a detection coil;

a core body around which the exciting coil and the detection coil are wound; and a control unit to which the detection coil is connected;

wherein, the core body comprises a first core, placed at a first side in a thickness direction of the identification object passing through the passage path, the exciting coil being wound around the first core; and a second core, placed at a second side in the thickness direction of the identification object passing through the passage path, the detection coil being wound around the second core;

wherein an analog coil output signal created on the basis of an output from the detection coil is input into the control unit, a signal level of the coil output signal rising if the identification object passes through the passage path;

the control unit is configured to obtain a signal value of the coil output signal at a time when the signal level of the coil output signal is equal to or higher than a predetermined threshold, and identify the identification object on the basis of the obtained signal value of the coil output signal; and among identification objects of multiple types, an identification object having a largest outer diameter, a thickest thickness, and a lowest electrical resistivity is a first identification object; and an identification object having a smallest outer diameter, a thinnest thickness, and a highest electrical resistivity is a second identification object; and where a first thickness represents a thickness of the core body in a passing direction of the identification objects in the case where a bottom value of the signal level of the coil output signal, at a time when a plurality of first identification objects continuously pass with no space between every two of the first identification objects through the passage path, is equal to a peak value of the signal level of the coil output signal, at a time when the second identification objects pass through the passage path;

a thickness of the core body in the passing direction of the identification objects is less than the first thickness.

2. The device for identifying a coin-shaped identification object according to claim 1;

wherein, an outer diameter of the identification object is equal to or greater than 20 mm, and equal to or smaller than 32 mm;

a thickness of the identification object is equal to or thicker than 1.3 mm, and equal to or thinner than 2.5 mm; and a material of the identification object is one of aluminum alloy, stainless steel, brass, bronze, and cupronickel.

3. The device for identifying a coin-shaped identification object according to claim 2;

wherein, the outer diameter of the identification object is equal to or greater than 20 mm, and equal to or smaller than 30 mm;

the material of the identification object is one of stainless steel, brass, bronze, and cupronickel; and the first thickness is 1.2 mm.

4. The device for identifying a coin-shaped identification object according to claim 1;

wherein, the core body is configured as one metal plate that is made up by way of press working; and the core body is placed in such a way that the passing direction of the identification objects is a thickness direction of the core body.

5. A device for identifying a coin-shaped identification object to identify authenticity and/or condition of a coin-shaped identification object of multiple types, the device comprising:

a passage path, through which the identification object passes through;

an exciting coil and a detection coil;

a core body around which the exciting coil and the detection coil are wound; and a control unit to which the detection coil is connected;

wherein, the core body comprises a first core, placed at a first side in a thickness direction of the identification object passing through the passage path, the exciting coil being wound around the first core; and a second core, placed at a second side in the thickness direction of the identification object passing through the passage path, the detection coil being wound around the second core;

wherein an analog coil output signal created on the basis of an output from the detection coil is input into the control unit, a signal level of the coil output signal falling if the identification object passes through the passage path;

the control unit is configured to obtain a signal value of the coil output signal at a time when the signal level of the coil output signal is equal to or lower than a predetermined threshold, and identify the identification object, on the basis of the obtained signal value of the coil output signal; and among identification objects of multiple types, an identification object having a largest outer diameter, a thickest thickness, and a lowest electrical resistivity a first identification object; and an identification object having a smallest outer diameter, a thinnest thickness, and a highest electrical resistivity is a second identification object; and where a first thickness represents a thickness of the core body in a passing direction of the identification objects in the case where a peak value of the signal level of the coil output signal, at a time when a plurality of first identification objects continuously pass with no space between every two of the first identification objects through the passage path, is equal to a bottom value of the signal level of the coil output signal, at a time when the second identification objects pass through the passage path;

a thickness of the core body in the passing direction of the identification objects is less than the first thickness.

6. The device for identifying a coin-shaped identification object according to claim 5;

wherein, an outer diameter of the identification object is equal to or greater than 20 mm, and equal to or smaller than 32 mm;

a thickness of the identification object is equal to or thicker than 1.3 mm, and equal to or thinner than 2.5 mm; and a material of the identification object is one of aluminum alloy, stainless steel, brass, bronze, and cupronickel.

7. The device for identifying a coin-shaped identification object according to claim 6;

wherein, the outer diameter of the identification object is equal to or greater than 20 mm, and equal to or smaller than 30 mm;

the material of the identification object is one of stainless steel, brass, bronze, and cupronickel; and the first thickness is 1.2 mm.

8. The device for identifying a coin-shaped identification object according to claim 5;

wherein, the core body is configured as one metal plate that is made up by way of press working; and the core body is placed in such a way that the passing direction of the identification objects is a thickness direction of the core body.

* * * * *